US012515763B2

(12) United States Patent
Hasselskog

(10) Patent No.: US 12,515,763 B2
(45) Date of Patent: Jan. 6, 2026

(54) BOAT WITH HYDROFOILS

(71) Applicant: Candela Technology AB, Lidingö (SE)

(72) Inventor: Gustav Hasselskog, Stockholm (SE)

(73) Assignee: Candela Technology AB, Lidingö (SE)

( * ) Notice: Subject to any disclaimer, the term of this patent is extended or adjusted under 35 U.S.C. 154(b) by 658 days.

(21) Appl. No.: 17/812,507

(22) Filed: Jul. 14, 2022

(65) Prior Publication Data

US 2023/0033965 A1 Feb. 2, 2023

(30) Foreign Application Priority Data

Jul. 28, 2021 (SE) ..... 2150972-4
Jul. 28, 2021 (SE) ..... 2150973-2
Jul. 28, 2021 (SE) ..... 2150974-0
Nov. 4, 2021 (SE) ..... 2151352-8

(51) Int. Cl.
*B63B 1/30* (2006.01)

(52) U.S. Cl.
CPC ..... *B63B 1/30* (2013.01)

(58) Field of Classification Search
CPC ..... B63B 1/00; B63B 1/30
USPC ..... 114/282, 280, 284
See application file for complete search history.

(56) References Cited

U.S. PATENT DOCUMENTS 3,016,863 A 1/1962 Johnson, Jr.
3,357,389 A 12/1967 Wray, Jr.
4,936,240 A 6/1990 Yokoyama
5,117,776 A 6/1992 Thorpe
10,532,793 B2 * 1/2020 Lagarrigue ..... B63B 1/30
2016/0264225 A1 9/2016 Coleman
2017/0361902 A1 12/2017 Clark

FOREIGN PATENT DOCUMENTS

CA 3156738 A1 5/2021
WO 96/40547 A1 12/1996
WO 2020056530 A2 3/2020

OTHER PUBLICATIONS

"Extended European Search Report", issued by the European Patent Office, in EP Application No. 22185887.1, completed Dec. 2, 2022, 9 pages.

* cited by examiner

*Primary Examiner* — Lars A Olson
(74) *Attorney, Agent, or Firm* — Schott, P.C.

(57) ABSTRACT

A boat includes a hull (2), a hydrofoil (301, 601) mounted to the hull (2) by means of a hydrofoil holding arrangement (302) that has a strut (3021, 503). The boat also includes a strut adjustment arrangement (310, 510) arranged to retract the strut (3021, 503) from an extended position to a retracted position so as to move the hydrofoil (301, 601) from a deployed position to a restrained position, and/or to lock the strut in the extended position and/or in the retracted position. At least a portion of the strut has a hydrodynamic portion forming a leading edge (5036) and a blunt trailing edge (5037), where a sheltered portion (5101', 5104, 5108) of the strut adjustment arrangement is positioned.

9 Claims, 23 Drawing Sheets

BOAT WITH HYDROFOILS

TECHNICAL FIELD

The invention relates to a boat comprising a hull, and a hydrofoil mounted to the hull by means of a hydrofoil holding arrangement comprising a strut. The invention also relates to a strut for mounting a hydrofoil to a hull of a boat.

BACKGROUND

Hydrofoil boats can provide an energy efficient type of marine transportation. However, a disadvantage with such boats is that the hydrofoils, and the structures holding them, are prone to being damaged if hitting the seabed, or floating objects.

WO2020056530A2 discloses the hydrofoils of hydrofoil boats being folded away for their protection from collisions with floating objects or the seabed. However, actuators and linkage for providing such foldability increases the complexity of the boats, and therefore their cost. Also, where linkage for the foldability is below the water surface, it increases drag, and therefore reduces the energy efficiency of the boats.

SUMMARY

An object of the invention is to provide a hydrofoil boat in which the hydrofoils are protected from damage, while keeping the boat energy efficient.

The object is reached with a boat according to claim 1. Thus, the object is reached with a boat comprising a hull, a hydrofoil mounted to the hull by means of a hydrofoil holding arrangement comprising a strut, wherein the boat comprises a strut adjustment arrangement arranged to retract the strut from an extended position to a retracted position so as to move the hydrofoil from a deployed position to a restrained position, and/or to lock the strut in the extended position and/or in the retracted position, wherein at least a portion of the strut has a hydrodynamic portion forming a leading edge and a blunt trailing edge, wherein a sheltered portion of the strut adjustment arrangement is positioned, and/or arranged to be positioned, so that an extension of the sheltered portion in a longitudinal direction of the strut is within an extension of the blunt trailing edge in the longitudinal direction of the strut, and so that the sheltered portion is located behind the blunt trailing edge as seen in the direction of straight forward travel of the boat, and/or in one or more cavities in the hydrodynamic portion, which one or more cavities extend from the blunt trailing edge.

The boat may be of a variety of different types. For example, the boat may be a power boat, a pleasure boat, or a boat for commercial operations, such as carrying passengers and/or goods, or surveillance or servicing. In some embodiments, the boat may be a military boat.

The strut adjustment arrangement may be arranged to retract the strut from the extended position to the retracted position. Alternatively, or in addition, the strut adjustment arrangement may be arranged to lock the strut in the extended position. Alternatively, or in addition, the strut adjustment arrangement may be arranged to lock the strut in the retracted position.

The strut may be arranged to extend at least partly downwards from the hull. The leading edge formed by the hydrodynamic portion may be rounded as seen in a transverse cross-section of the strut. However, in some embodiments, the leading edge formed by the hydrodynamic portion may be pointed.

The strut adjustment arrangement may comprise a first actuation device which is fixed to the strut, and a second actuation device which is engaged, or adapted to be engaged, with the first actuation device. The strut adjustment arrangement may further comprise a drive device adapted to adapted to impart a force to the second actuation device so as for the second actuation device to impart a force to the first actuation device so as to move the first actuation device, thereby moving the strut. The sheltered portion of the strut adjustment arrangement may comprise one or more first actuation devices. In some embodiments, the sheltered portion of the strut adjustment arrangement comprises one or more second actuation devices, or a portion of a second actuation device.

The sheltered portion may be formed by one or more parts of the strut adjustment arrangement. The sheltered portion may be located within an extension of the blunt trailing edge along the strut. In some embodiments, the sheltered portion of the strut adjustment arrangement is positioned, and/or arranged to be positioned, so as to be located behind the blunt trailing edge as seen in the direction of straight forward travel of the boat.

In other embodiments, the sheltered portion is positioned, and/or arranged to be positioned, so as to be located in one or more cavities in the hydrodynamic portion, which one or more cavities extend from the blunt trailing edge. In such embodiments, preferably, said one or more cavities extend from the blunt trailing edge in the direction of straight forward travel of the boat. Thereby, the sheltered portion of the strut adjustment arrangement may be located in front of the blunt trailing edge as seen in the direction of straight forward travel of the boat. In some embodiments, the one or more cavities may be formed by a groove extending in the longitudinal direction of the strut.

The sheltered portion of the strut adjustment arrangement, or one or more parts thereof, may, in the retracted position of the strut, be removed from the location behind the blunt trailing edge, and/or from the one or more cavities in the hydrodynamic portion.

For example, as exemplified below, the sheltered portion of the strut adjustment arrangement may comprise a part of an elongated flexible element, such as a rope or a wire, which is rolled up on a winch in the retracted strut position. However, in the extended strut position, at least a part of the elongated flexible element is positioned so as to be located behind the blunt trailing edge as seen in the direction of straight forward travel of the boat, and/or in one or more cavities in the hydrodynamic portion which one or more cavities extend from the blunt trailing edge. Thereby, at least a part of the elongated flexible element is arranged to be positioned so as to be located behind the blunt trailing edge as seen in the direction of straight forward travel of the boat, and/or in one or more cavities in the hydrodynamic portion which one or more cavities extend from the blunt trailing edge.

Thus, the sheltered portion of the strut adjustment arrangement may be arranged to be positioned, when the strut is in the extended position, so as to be located behind the blunt trailing edge as seen in the direction of straight forward travel of the boat, and/or in one or more cavities in the hydrodynamic portion which one or more cavities extend from the blunt trailing edge.

The blunt trailing edge formed by the hydrodynamic portion may be formed by one or more surfaces that form, in a transverse cross-section of the strut, one or more angles of 60-120 degrees, preferably 70-110 degrees, to a chord line of the hydrodynamic portion. For example, the one or more surfaces forming the blunt trailing edge may be perpendicular to the chord line of the hydrodynamic portion. The one or more surfaces forming the blunt trailing edge may extend along the strut. The chord line may coincide with a line of symmetry of the hydrodynamic portion. The chord line may extend from the leading edge to a mid-point of the blunt trailing edge. Preferably, as seen in a transverse cross-section of the strut, the one or more surfaces forming the blunt trailing edge are straight. Alternatively, the one or more surfaces forming the blunt trailing edge may be curved.

Preferably, as seen in a transverse cross-section of the strut, the one or more surfaces forming the blunt trailing edge form corners with respective side surfaces of the hydrodynamic portion. The corners may be formed by surfaces oriented at an angle to each other of 70-110 degrees. The corners may have small radii, e.g. less than 1/10 of the width of the blunt trailing edge. Thereby, the corners may be abrupt. Thereby, at the corners, separations of the water flow past the side surfaces of the hydrodynamic portion, will be provided. Thereby, a cavity will be created behind the blunt trailing edge, as described below.

The sheltered portion is positioned, and/or arranged to be positioned, so as to be located within an extension of the blunt trailing edge along the strut. I.e., the sheltered portion is positioned, and/or arranged to be positioned, so as to be located within an extension of the blunt trailing edge in the longitudinal direction of the strut. Thus, when the boat is travelling straight forward, the vertical extension of the sheltered portion of the strut adjustment arrangement may be within the vertical extension of the blunt trailing edge.

Preferably, at least a part of the sheltered portion of the strut adjustment arrangement is positioned so as to be below the water surface when the boat is travelling straight in a hydrofoil mode on calm water. Thereby, a part of the sheltered portion may be positioned above the water surface when the boat is travelling straight in a hydrofoil mode on calm water.

Preferably, the sheltered portion of the strut adjustment arrangement extends, or is arranged to extend, transversely to a chord line of the hydrodynamic portion, and transversely to a longitudinal axis of the strut, no further from the chord line than the extension of the blunt trailing edge in a direction which is transverse to the chord line and transverse to the strut longitudinal axis. Thereby, the sheltered portion of the strut adjustment arrangement may be located within an extension of one or more surfaces formed by the blunt trailing edge, which extension is transverse to the chord line of the hydrodynamic portion. Thereby, in a width direction of the blunt trailing edge, the sheltered portion of the strut adjustment arrangement does not extend further than the blunt trailing edge. Thus, the sheltered portion is located within a lateral extension of the strut.

As understood from above, in some embodiments, the sheltered portion of the strut adjustment arrangement is, or is arranged to be, behind the blunt trailing edge as seen in a direction along the chord line from the trailing edge towards the leading edge. Preferably, the sheltered portion of the strut adjustment arrangement is, or is arranged to be, entirely within a maximum distance from the blunt trailing edge, which maximum distance is 300%, preferably 200%, preferably 100%, preferably 50%, preferably 30%, preferably 20%, of the extension of the hydrodynamic portion along the chord line of the hydrodynamic portion. The sheltered portion of the strut adjustment arrangement may be distributed along an extension of the chord line, behind the trailing edge.

By the blunt trailing edge, the strut may form a ventilated profile. The strut may be a base ventilated profile. In some embodiments, the strut may form a supercavitating profile. Thereby, base ventilated sections may be provided with a base cavity vented to the atmosphere. The cavity created behind the blunt trailing edge may form an air passage from the atmosphere downwards along the strut. The blunt trailing edge reduces the risk of ventilation of the parts of the section between the leading and trailing edges. A necessary condition for ventilation is flow separation. Flow separation in turn presupposes that the flow rate decreases along the profile, as seen from the strut. The speed of the water increases as the profile increases in thickness. The maximum speed may be reached approximately at a location where the profile has its maximum thickness. Downstream of this location the speed decreases. Thereby, the flow risks separating. If there is access to air, e.g. since the strut extends upwards and reached above the water surface, there is a risk that air will be sucked into a cavity created by the separated flow. Thereby, ventilation occurs. A problem with ventilation is that it usually comes suddenly and generally on only one side. Then most of the negative pressure on the ventilated side will be lost. This creates a force in a transverse direction of the boat. Such ventilation may, where the strut is located at or near the stern of the boat, create a yaw moment. Such ventilation may, where the strut is located closer to the center of gravity of the boat, create a roll moment.

With the blunt trailing edge, such ventilation may be avoided. Instead, with a ventilated profile, a stable air pocket, or air filled cavity, may form behind the strut.

In addition, the ratio of flexural stiffness to water resistance may be better for a ventilated profile than for a conventional profile, for example a conventional profile of similar proportions.

In embodiments of the invention, as the vessel is moving forwards, the sheltered portion of the strut adjustment arrangement is sheltered from the water freestream. Thereby, as the vessel is moving forwards, the invention allows the sheltered portion of the strut adjustment arrangement to be located in a wake formed by the strut. The invention thus allows for the use of the space behind the profile, or the one or more cavities in the blunt trailing edge, for the sheltered portion of the strut adjustment arrangement. This position means that said one or more parts do not affect the water resistance. I.e., the air cavity that is formed behind the blunt trailing edge, and/or in one or more cavities in the blunt trailing edge, is used for the strut adjustment arrangement without affecting the water flow.

The one or more parts of the strut adjustment arrangement being located behind the blunt trailing edge, and/or in one or more cavities in the blunt trailing edge, to reduce the resistance of the boat, is useful at boat speeds above 45 knots as well as at lower speeds. Thus, in embodiments of the invention, the boat may have a maximum speed of less than 40 knots, e.g. less than 35 knots. The boat may nevertheless have a maximum speed of more than 15 knots, e.g. more than 18 knots.

The ability to retract the strut from the extended position to the retracted position allows for operations in shallow water, for beach landings and/or putting the boat on a trailer. Also, the retraction capacity allows for protecting the hydrofoil from growth of sea weed etc., which may compromise the efficiency of the boat. The retraction capacity may further allow for a semi-foiling or a pure planing mode where the foils are higher up to reduce strut drag while still providing some lift to reduce the hull drag.

As understood, the one or more parts of the strut adjustment arrangement being located behind the blunt trailing edge, and/or in one or more cavities in the blunt trailing edge, allows for the retractability without causing an increase of the resistance of the boat.

By having one or more parts of the strut adjustment arrangement positioned so as to be located behind the blunt trailing edge as seen in the direction of straight forward travel of the boat, and/or in one or more cavities in the blunt trailing edge, the one or more parts may extend along the strut. Thereby, the sheltered portion of the strut adjustment arrangement may be close to the strut. The strut adjustment arrangement may be arranged to retract the strut by moving the strut along a longitudinal axis of the strut. Thereby the strut may be arranged to be retracted without rotation. This, in combination with having the sheltered portion of the strut adjustment arrangement positioned, or arranged to be positioned, so as to be located behind the blunt trailing edge as seen in the direction of straight forward travel of the boat, and/or in one or more cavities in the blunt trailing edge, allows for short moment arms of the strut adjustment arrangement.

Such short moment arms will decrease the complexity and/or weight of the strut adjustment arrangement. A low weight will contribute to retaining the energy efficiency of the boat. Thus, the invention allows for simple embodiments of the strut adjustment arrangement to protect the hydrofoils from damage, while keeping the boat energy efficient.

In addition, the strut being arranged to be retracted without rotation, allows for adjustments from the retracted to extended positions, and vice versa, when the boat is moving. Thereby, the hydrofoil can remain at substantially the same angle of attack while being moved from the restrained position to the deployed position, and vice versa. As opposed to this, with a foldable/rotating mechanism, the hydrofoil could assume an angle of attack in which it would cause a strong resistance and/or a strong vertical force, when it is rotating from one position to the other.

Preferably, all parts of the strut adjustment arrangement that are arranged to be under the water surface when the boat is travelling in a hydrofoil mode, are located behind the blunt trailing edge as seen in the direction of straight forward travel of the boat, and/or in one or more cavities in the hydrodynamic portion which one or more cavities extend from the blunt trailing edge. Preferably, in the hydrofoil mode, the hull is lifted out of the water.

Thereby, the sheltered portion of the strut adjustment arrangement may comprise all parts of the strut adjustment arrangement that are arranged to be under the water surface when the boat is travelling in a hydrofoil mode.

The parts of the strut adjustment arrangement that are arranged to be under the water surface when the boat is travelling in a hydrofoil mode, may form a wet portion of the strut adjustment arrangement. The wet portion may be a portion of the strut adjustment arrangement that is arranged to be under the water surface when the boat is travelling in a hydrofoil mode, straight ahead, and on flat water. Thereby, a further feature that defines the wet portion may be that the boat travels with maximum engine or motor power. A further feature that defines the wet portion may be that the boat is loaded with its maximum weight. A requirement for the hydrofoil mode may be that the entire hull is above the surface of the water. Thus, preferably the wet portion of the strut adjustment arrangement is positioned, and/or arranged to be positioned, so as to be located behind the blunt trailing edge as seen in the direction of straight forward travel of the boat, and/or in one or more cavities in the hydrodynamic portion, which one or more cavities extend from the blunt trailing edge.

In further embodiments, the sheltered portion of the strut adjustment arrangement comprises a rest submerged portion of the strut adjustment arrangement, which rest submerged portion is arranged to be under the water surface when the boat is floating at rest in flat water. Thereby, a further feature that defines the rest submerged portion may be that the boat is loaded with its maximum weight. A further feature that defines the rest submerged portion may be that the strut is in its extended position. Thus, preferably the rest submerged portion of the strut adjustment arrangement is positioned, and/or arranged to be positioned, so as to be located behind the blunt trailing edge as seen in the direction of straight forward travel of the boat, and/or in one or more cavities in the hydrodynamic portion, which one or more cavities extend from the blunt trailing edge.

In some embodiments, the boat comprises a propeller arrangement which is mounted to the strut. Thereby, when the boat is floating at rest, the blunt trailing edge may be terminated above a vertical extension of a propeller disc formed by the propeller arrangement. Below the blunt trailing edge, the strut may present a sharp trailing edge. Thereby, an air pocket formed behind the blunt trailing edge may not reach the propeller arrangement. Thereby, air disturbing the propeller operation may be avoided. The propeller arrangement may comprise one or more propellers. The propeller disc may be formed by the swept area of the blades of a propeller of the propeller arrangement. Where the propeller arrangement comprises more than one propeller, e.g. two coaxial propellers, the propeller disc may be regarded as the propeller disc of one of the propellers. Where the propellers have discs of unequal size, the blunt trailing edge may be terminated above a vertical extension of the largest propeller disc.

Preferably, the boat is arranged so that the blunt trailing edge extends above the water surface, from below the water surface, when boat is travelling straight in a hydrofoil mode on calm water. Thereby, the blunt trailing edge may extend above the wet portion of the strut adjustment arrangement, mentioned above.

Preferably, the sheltered portion of the strut adjustment arrangement, comprises a first engagement device, wherein the strut adjustment arrangement comprises a second engagement device arranged to engage with the first engagement device to lock the strut in the retracted position. Thereby, the one or more parts of the strut adjustment arrangement, that are positioned so as to be located behind the blunt trailing edge, and/or in one or more cavities in the blunt trailing edge, may comprise a first engagement device, wherein the strut adjustment arrangement comprises a second engagement device arranged to engage with the first engagement device to lock the strut in the retracted position. The sheltered portion of the strut adjustment arrangement may further comprise a further first engagement device. The second engagement device may be arranged to engage with further the first engagement device to lock the strut in the extended position. Thus, strut adjustment arrangement may comprise a locking arrangement for locking the strut in the retracted position, and preferably in the extended position.

Thereby, one or more first engagement devices for locking the strut may be located directly on the strut. This allows for no, or short, moment arms for the strut locking arrangement, which allows a simple or light weight structure for the locking arrangement.

The first engagement device could be provided in the form of a locking protrusion extending from the blunt trailing edge. The locking protrusion may comprise a recess or a through opening, arranged to receive a movable male engagement element of the second engagement device. A plurality of such locking protrusions may form a ridge raised from the blunt trailing edge, and extending along the blunt trailing edge. More generally, two first engagement devices may be distributed along the blunt trailing edge, whereby the second engagement device is arranged to engage with one of the first engagement devices to lock the strut in the retracted position, and with the other of the first engagement devices to lock the strut in the extended position.

In some embodiments, the first engagement device comprises a recess in the blunt trailing edge, arranged to receive a movable male engagement element of the second engagement device. Alternatively, the first engagement device could comprise a male engagement element mounted to the strut, and the second engagement device could comprise a movable element with a recess arranged to accept the male engagement element.

Regardless of the embodiment of the strut adjustment arrangement, the one or more first engagement devices are preferably arranged to be located behind the blunt trailing edge as seen in the direction of straight forward travel of the boat, and/or in, more specifically as, one or more cavities in the blunt trailing edge.

As suggested, in some embodiments, the sheltered portion of the strut adjustment arrangement comprises at least a part of an elongated flexible device, for example a rope, wire, or cable, extending along the blunt trailing edge. Thereby, the one or more parts of the strut adjustment arrangement, that are positioned so as to be located behind the blunt trailing edge as seen in the direction of straight forward travel of the boat, and/or in one or more cavities in the hydrodynamic portion which one or more cavities extend from the blunt trailing edge, may comprise at least a part of an elongated flexible device extending along the blunt trailing edge, wherein the strut is arranged to be retracted from the extended position to the retracted position by being pulled by the elongated flexible device. Thereby, the strut may be arranged to be retracted from the extended position to the retracted position by being pulled by the elongated flexible device. Thereby, the strut may be pulled along a longitudinal extension of the strut.

The elongated flexible device may be engaged with the strut for said pulling of the strut. The elongated flexible element may be engaged with a fastening element which is fixed to the strut. The fastening element may be in the form of a protrusion, with an opening in it. Thereby, the elongated flexible element may extend through the opening to be fastened to the protrusion. The protrusion may be in the form of a bracket, a ridge, a U-nail, a staple, or similar. The protrusion may protrude from the blunt trailing edge. For example, a ridge, with recesses or through holes for locking the strut in the retracted and extended positions, may be raised from the blunt trailing edge, and may extend along the blunt trailing edge. Thereby, the elongated flexible device may be fastened to the ridge below the recesses or through holes.

The protrusion may form what is herein referred to as a first actuation device, and the elongated flexible element may form what is herein referred to a second actuation device. A winch for the elongated flexible element may form what is herein referred to as a drive device.

In alternative embodiments, the sheltered portion of the strut adjustment arrangement comprises teeth distributed along the blunt trailing edge, e.g. forming a rack of teeth. Thereby, a motorized toothed pinion wheel, fixed to the strut holding assembly, may be arranged to engage with the strut teeth, and rotate, so as to drive the strut up or down. The teeth distributed along the blunt trailing edge may form what is herein referred to as first actuation devices. The teeth of the pinon wheel may form what is herein referred to as second actuation devices. The remainder of the motorized toothed pinion wheel may form what is herein referred to as a drive device.

The boat may comprise a first hydrofoil mounted to the hull by means of a first hydrofoil holding arrangement, and a second hydrofoil mounted to the hull by means of a second hydrofoil holding arrangement. The first hydrofoil and/or the second hydrofoil may be a hydrofoil as described above, and the first hydrofoil holding arrangement and/or the second hydrofoil holding arrangement may be the hydrofoil holding arrangement as described above. Thereby, the second hydrofoil holding arrangement may be separate from the first hydrofoil holding arrangement. The first hydrofoil holding arrangement may comprise one or more first hydrofoil struts. The first and/or second hydrofoil strut may be arranged to extend at least partly downwards from the hull when the boat is floating in an upright condition. The first and/or second hydrofoil strut may extend straight vertically, or at a non-zero angle to a vertical axis. The first and/or second hydrofoil may be fixed to a respective strut.

In some embodiments, the second hydrofoil strut and/or the one or more first hydrofoil struts are arranged to be pulled at least partly downwards by a respective elongated flexible device from the retracted position to the extended position. In other embodiments, the second hydrofoil strut and/or the one or more first hydrofoil struts may be arranged to be moved from the retracted position to the extended position by gravity only.

The second hydrofoil may be located behind the first hydrofoil as seen in a direction of straight forward travel of the boat. Alternatively, the second hydrofoil may be located in front of the first hydrofoil as seen in a direction of straight forward travel of the boat.

The object is also reached with a strut according to claim 8. Thus, the object is reached with a strut for mounting a hydrofoil to a hull of a boat. The strut comprises one or more parts for a strut adjustment arrangement arranged to retract the strut from an extended position to a retracted position so as to move the hydrofoil from a deployed position to a restrained position, and/or to lock the strut in the extended position and/or in the retracted position. At least a portion of the strut has a hydrodynamic portion forming a leading edge and a blunt trailing edge, wherein the one or more parts for the strut adjustment arrangement are located, in a direction of a chord line of the hydrodynamic portion, on a side of the hydrodynamic portion comprising the blunt trailing edge, and/or in one or more cavities in the hydrodynamic portion, which one or more cavities extend from the blunt trailing edge. The one or more parts for the strut adjustment arrangement may be positioned, and/or arranged to be positioned, so that an extension of the one or more parts for the strut adjustment arrangement in a longitudinal direction of the strut is within an extension of the blunt trailing edge in the longitudinal direction of the strut. By the one or more parts for the strut adjustment arrangement being located on the side of the hydrodynamic portion comprising the blunt trailing edge, the one or more parts for the strut adjustment arrangement may be located, when the strut is mounted to the hull, behind the blunt trailing edge as seen in the direction of straight forward travel of the boat.

For example, the object is reached with a strut for mounting a hydrofoil to a hull of a boat, wherein at least a portion of the strut has a hydrodynamic portion forming a leading edge and a blunt trailing edge, wherein the strut presents one or more cavities in the hydrodynamic portion which one or more cavities extend from the blunt trailing edge, which one or more cavities are adapted to house one or more parts for a strut adjustment arrangement arranged to retract the strut from an extended position to a retracted position so as to move the hydrofoil from a deployed position to a restrained position, and/or to lock the strut in the extended position and/or in the retracted position.

A second aspect of the invention provides a boat comprising a hull, a first hydrofoil mounted to the hull by means of a first hydrofoil holding arrangement, a second hydrofoil mounted to the hull by means of a second hydrofoil holding arrangement comprising a strut which is separate from the first hydrofoil holding arrangement, the strut being arranged to extend at least partly downwards from the hull, the second hydrofoil being fixed to the strut, a torque generating assembly, and a propeller arrangement arranged to be driven by the torque generating assembly, wherein the propeller arrangement is mounted to the strut, wherein the second hydrofoil strut is arranged to be retracted from an extended position to a dry position in which the propeller arrangement and the second hydrofoil are above the water surface when the boat is floating at rest, wherein the arrangement of the strut to be retracted from the extended position to the dry position comprises the strut being arranged to be moved along a longitudinal axis of the strut.

By the arrangement of the strut to be retracted from the retracted position to the dry position, fouling of the propeller arrangement and the second hydrofoil can be avoided. More specifically, the risk of growth and corrosion on the second hydrofoil when at standstill is reduced or eliminated. Also, any of the extended, retracted, and dry positions can be reached by the strut being moved along a longitudinal axis of the strut. Thereby, a single strut adjustment arrangement can be used to reach all three positions. This allows a relatively simple assembly for the strut adjustment.

For marine vessels, for example pleasure boats, the mode of progress may, if enough power capacity is available for its propulsion, be transformed from a displacement mode to a planing mode. By means of hydrofoils, a boat can assume a hydrofoil mode of progress. During the hydrofoil mode, the hull is lifted out of the water. Thereby, the propulsion power requirement may be reduced.

Nevertheless, when waves are relatively high, a hydrofoil boat may encounter problems in that waves hit the hull lifted by the hydrofoils, which may create discomfort to persons in the boat, and also reduce the speed of the boat so much that the hydrofoils can no longer support the hull thereof. Also, a hydrofoil boat when it is not in the hydrofoil mode has a draft which is relatively large, and which may create problems when travelling in shallow waters, e.g. when docking the boat.

Preferably, the strut is arranged to be retracted from the extended position to a retracted position so as to move the propeller arrangement from a deployed position to a restrained position, in which restrained position the propeller arrangement is positioned to be submerged in water carrying the boat, wherein the propeller arrangement is, in the deployed position, located further down than in the restrained position, wherein, in the extended position as well as in the retracted position, the strut, with the propeller arrangement, is arranged to be turned in relation to the hull so as to steer the boat.

Thereby, the propeller arrangement may be kept under water for a planing mode of the boat. Thereby, the strut, the second hydrofoil, and the propeller arrangement, may be extended and retracted, for generating a thrust, and providing a boat steering capacity, in the hydrofoil mode, as well as in the planing mode of the boat.

The planing mode may be useful in wavy conditions, where waves may hit the boat hull if the boat is in the hydrofoil mode. The second hydrofoil may be arranged to be, in the restrained position, submerged in the surrounding water. Thereby, in the planing mode, the second hydrofoil may serve to lift the stern of the boat, which may reduce the drag of the boat. Thereby, the boat may travel with a high power efficiency in the planing mode, as well as in the hydrofoil mode.

The second hydrofoil strut may be arranged to be retracted from the retracted position to the dry position in which the propeller arrangement and the second hydrofoil are above the water surface when the boat is floating at rest.

By the strut being arranged to be moved along a longitudinal axis of the strut, the strut may be retractable along the strut longitudinal axis. Thereby, the strut may be retracted without rotation. For example, where the strut is, by means of a strut turning bearing assembly, pivotally connected to the hull, a strut holding assembly, e.g. comprising one or more strut holding brackets, may be connected to the strut turning bearing assembly. Thereby, the strut holding assembly may be turnable. Thereby, the strut holding assembly may hold the strut transversally, and may be turnable so as to turn the strut for boat steering. For the retraction, the strut may be moved in relation to the one or more brackets along the strut longitudinal axis.

The strut being arranged to be retracted without rotation, allows for adjustments from the retracted to extended positions, and vice versa, when the boat is moving. Thereby, the hydrofoil can remain at substantially the same angle of attack while being moved from the restrained position to the deployed position, and vice versa. As opposed to this, with a foldable/rotating mechanism, the hydrofoil could assume an angle of attack in which it would cause a strong resistance and/or a strong vertical force, when it is rotating from one position to the other.

Preferably, the second hydrofoil is fixed to the second hydrofoil strut at a position along a longitudinal extension of the strut being within an extension of the propeller arrangement along the longitudinal extension of the strut. Thereby, the second hydrofoil and the propeller arrangement may be at substantially the same position along the strut. Thereby, said benefits of the propeller arrangement and the second hydrofoil in the retracted position of the strut, i.e. in a planing mode of the boat, may be obtained while minimizing the vertical extension of the combination of the propeller arrangement and the second hydrofoil. Thereby, the draft of the boat in the planing mode can be limited. Also, for the dry position of the strut, the distance required between the water surface and a strut lifting arrangement can be kept low due to the limited vertical extension of the combination of the propeller arrangement and the second hydrofoil.

The torque generating assembly may be of any suitable type. For example, it may comprise one or more internal combustion engines, one or more electric motors, or one or more hydraulic motors. In some embodiments, the torque generating assembly may be a hybrid powertrain, e.g. comprising one or more internal combustion engines and/or one or more electric motors and/or one or more hydraulic motors.

The strut to which the second hydrofoil is fixed is herein also referred to as a second hydrofoil strut. The strut is arranged to extend at least partly downwards from the hull when the boat is floating in an upright condition. The strut may extend straight vertically, or at a non-zero angle to a vertical axis.

The propeller arrangement may comprise one or more propellers. The one or more propellers may be un-ducted or ducted. The rotational axes of the one or more propellers may be fixed in relation to the strut. The propeller arrangement may be mounted to a lower end of the strut. However, in some embodiments, the propeller arrangement may be mounted above a lower end of the strut.

The second hydrofoil may be fixed to a lower end of the strut. However, in some embodiments, the second hydrofoil may be fixed above a lower end of the strut.

In some embodiments, the strut is retractable from the extended position to the retracted position. In the extended position of the strut, the second hydrofoil assumes a deployed position, and in the retracted position of the strut, the second hydrofoil assumes a restrained position. Just like the propeller arrangement, the second hydrofoil is, in the deployed position, located further down than in the restrained position. The relationship of the propeller arrangement, or the second hydrofoil, being further down in the deployed position than in the restrained position, should be understood in a context of the boat floating in an upright condition.

Thus, in the extended position as well as in the retracted position, the strut, with the propeller arrangement, is turnable in relation to the hull so as to steer the boat. The ability of the strut to turn or rotate in relation to the hull so as to steer the boat, may be provided by means of a strut turning bearing assembly, comprising one or more strut bearings, whereby the strut is pivotally connected to the hull so that the strut and the propeller arrangement are turnable in relation to the hull so as to steer the boat. The strut turning bearing assembly may be connected to the hull via a strut mounting arrangement for mounting the strut to the hull. Thus, the second hydrofoil holding arrangement may comprise, in addition to the strut, the strut turning bearing assembly and the strut mounting arrangement.

It should be noted that in some embodiments, the second hydrofoil is arranged to be above the water in the restrained position when the boat is in the planning mode. For this, the second hydrofoil may be fixed to the strut above the propeller arrangement.

Preferably, the first hydrofoil holding arrangement for mounting the first hydrofoil to the hull is arranged to be retracted from an extended position to a retracted position so as to move the first hydrofoil from a deployed position to a restrained position, wherein the first hydrofoil is, in the deployed position, located further down than in the restrained position.

Preferably, in the restrained position, the first hydrofoil is removed from the water passing the boat as the boat moves. In the restrained position, the first hydrofoil could be placed in a recess of the hull. The recess could open downwards. At the retraction of the first hydrofoil holding arrangement, the first hydrofoil could be moved upwards into the recess.

In some embodiments, the first hydrofoil is arranged to be submerged in the restrained position. Thereby, the restrained position may be used for a semi-foiling mode of the boat. In the semi-foiling mode, the hydrofoils may create lift to reduce the friction of the hull against the water. The semi-foiling mode may be useful in rough seas. Thereby, the first hydrofoil may be in a first restrained position in which it is partially deployed and arranged to be submerged, and in a second restrained position, in which it is removed from the water passing the hull during travel. The first restrained position may be used for the semi-foiling mode, and the second restrained position may be used for a planing mode.

For such embodiments, when the first hydrofoil is in the first restrained position, the second hydrofoil may also be in a first restrained position in which it is partially deployed and arranged to be submerged, and in a second restrained position, in which it is still submerged, but above the first restrained position. Thus, the first restrained position of the second hydrofoil may be used for the semi-foiling mode, and the second restrained position of the second hydrofoil may be used for a planing mode.

However, in some embodiments, the first hydrofoil may be movable to a single restrained position, e.g. for a semi-foiling mode. Thereby, the second hydrofoil may be movable to a single restrained position, e.g. for the semi-foiling mode.

In some embodiments, the first hydrofoil holding arrangement comprises one, two or more struts extending from the hull at least partly downwards. Such struts are herein also referred to as first hydrofoil struts.

The second hydrofoil may be located behind the first hydrofoil as seen in a direction of straight forward travel of the boat. Alternatively, the second hydrofoil may be located in front of the first hydrofoil as seen in a direction of straight forward travel of the boat. Where the first hydrofoil holding arrangement comprises one, two, or more first hydrofoil struts, and the first hydrofoil holding arrangement is arranged to be retracted, the one or more first hydrofoil struts may be arranged to be moved along respective longitudinal axes of the first hydrofoil struts. Thereby, the first hydrofoil holding arrangement may be arranged to be retracted by lifting the one or more struts along their longitudinal axes. Thereby, the first hydrofoil holding arrangement may be retracted without rotation. In other embodiments the one or more first hydrofoil struts are retracted by being folded.

Where the first hydrofoil is arranged to be retracted, in the restrained position the first hydrofoil may be above the water surface when the boat is floating at rest. Thereby, the risk of growth and corrosion on the first hydrofoil when at standstill is reduced or eliminated. This may be achieved by a recess in the hull which is deep enough to allow the first hydrofoil to be moved above the water surface. The recess can be adapted to form a step in the hull. Such a step may serve to allow air to lubricate the hull when the boat travels in the planing mode.

The torque generating assembly and the propeller arrangement may form parts of a propulsion device. Preferably, the propulsion device is provided in the form of a motor pod.

Thus, preferably, the propeller arrangement and the torque generating assembly form parts of a motor pod fixed to the second hydrofoil strut. Thereby, the strut and the motor pod are arranged to be turned in relation to the hull so as to steer the boat. The motor pod may comprise a casing, the torque generating assembly housed in the casing, and the propeller arrangement arranged to be driven by the torque generating assembly. The propeller arrangement may be upstream or downstream of the second hydrofoil strut as understood when the boat is travelling forward. I.e. the propeller arrangement may be pulling or pushing. The propeller arrangement may comprise two propellers which are counter-rotating.

By the torque generating assembly being included in the motor pod, which is fixed to the second hydrofoil strut, there is no need to include a driveshaft in the strut for delivering the power to the propeller arrangement. Thereby, moving the strut in order to retract it to the retracted position, and moving the strut away from the retracted position towards the extended position, is facilitated.

Preferably, the torque generating assembly comprises one, two or more electric motors. Thereby, electric power for the torque generating assembly may be delivered by one or more electric cables extending through the second hydrofoil strut. The power may be provided by a battery pack, which may be provided in the hull. The one or more cables are preferably flexible. Thereby the cable(s) may flex while the strut is moved to and from the retracted position.

The second hydrofoil and the motor pod may be at substantially the same position along the second hydrofoil strut. Thereby, wings of the second hydrofoil may extend from opposite sides of the motor pod. However, in some embodiment, the second hydrofoil and the propeller arrangement are at different positions along the strut. For example, the second hydrofoil may be fixed to the strut above the propeller arrangement. For example, where the strut comprises a lower strut part and an upper strut part, the second hydrofoil may be mounted to the strut, between the lower and upper strut parts, and the propeller arrangement mounted to the lower strut part. In other embodiments, the propeller arrangement is fixed to the strut above the second hydrofoil.

As suggested, one or more of the second hydrofoil strut adjustments arrangement may comprise an elongated flexible device. The, or each, elongated flexible device may be fastened to the respective strut. A drum or a wheel driven by a driving device, such as a motor, may be arranged to engage with the elongated flexible device, to pull up the strut. The drum and the driving device may form a winch. Such a drum or wheel may be fixed to a strut holding assembly, arranged to hold the strut transversally, and to be turnable so as to turn the strut for steering of the boat.

It should be noted that in some embodiments, mechanical power may be delivered to the propeller arrangement by a shaft extending inside the strut and along the longitudinal direction of the second hydrofoil strut. Thereby, the torque generating assembly may be fixed to an upper end of the strut.

Preferably, the hull presents a stern edge arranged so that water with which the hull is in contact in a planing mode of the boat, is released from the hull at the stern edge, wherein the second hydrofoil is in the retracted position of the second hydrofoil strut located behind the stern edge as seen in the direction of straight forward travel of the boat. The stern edge may be transverse or at least partly transverse, as seen in the direction of straight forward travel of the boat. Thereby, a center of lift acting on the boat in a planing mode thereof may be relatively far forward. This means that said center of lift in relation to the hull in a planing mode may be relatively close to a center of lift, in relation to the hull, acting on the hydrofoils in a hydrofoil mode of the boat. Thereby, a movement of the center of lift at a transition between these modes may be relatively small. Preferably, the distance from the center of gravity of the boat to the stern edge is no more than 90% of the distance from the boat center of gravity and the second hydrofoil.

Further variations are possible. For example, the propeller arrangement may be arranged to be more submerged than the first hydrofoil when the boat is travelling straight forward in a hydrofoil mode. In other embodiments, the propeller arrangement may be arranged to be at substantially the same depth as the first hydrofoil when the boat is travelling straight forward in a hydrofoil mode. The first hydrofoil may be a submerged type hydrofoil, or a surface piercing hydrofoil.

To reduce the complexity and cost of motor pod driven boats, a third aspect of the invention provides a boat as follows:

A boat comprising a hull, and a motor pod and a submergible structure, wherein the motor pod is mounted to the hull by means of the submergible structure, wherein the motor pod comprises a torque generating assembly, and a propeller arrangement arranged to be driven by the torque generating assembly, wherein the motor pod further comprises a casing, wherein the torque generating assembly is housed in the casing, wherein the casing comprises a recess, and the submergible structure extends into the recess of the casing wherein the submergible structure comprises a hydrofoil that partly surrounds the casing, and a further element that partly surrounds the casing so that the further element and the hydrofoil together fully surround the casing, wherein the further element and the hydrofoil are fastened to each other.

The casing may have an elongated shape. The casing may extend along a rotational axis of the propeller arrangement. The casing may extend in a direction of a thrust produced by the propeller arrangement. The casing may be hollow to house the torque generating assembly. By the torque generating assembly being included in the motor pod, which is mounted to the hull by means of the submergible structure, there is no need to include a driveshaft in the submergible structure for delivering the power to the propeller arrangement. Preferably, the torque generating assembly comprises one, two or more electric motors. Thereby, electric power for the torque generating assembly may be delivered by one or more electric cables extending through the submergible structure. The motor pod casing may be, e.g. by milling, provided with one or more through holes through which the cables extend from the casing interior to the submergible structure interior. The power may be provided by a battery pack, which may be provided in the hull.

By the submergible structure extending into the recess of the motor pod casing, the casing may be locked in a longitudinal direction of the motor pod. Thereby, the motor pod may be securely fixed to the submergible structure.

The casing recess allows a fixing of the casing to the submergible structure to be made by a mechanical engagement between the casing and the submergible structure. Thereby manufacturing of the casing and submergible structure combination may be made easy. More specifically, it is easy to integrate different materials for these parts. For example, the submergible structure may be made in a light-weight composite material, e.g. a fiber reinforced plastic material. The casing may be made in a metal, e.g. bronze or stainless steel. The casing recess allows for a simple assembly of these parts made from different materials.

Thus, a strong engagement of the casing to the submergible structure is provided, while allowing for an easy assembly of these parts without manufacturing complications. Thereby, the complexity and cost of motor pod driven boats may be reduced.

The recess may be provided as a waist in the casing. The casing, or one or more parts of the casing, may have a cylindrical shape. For example, parts of the casing on both sides of the recess, in the longitudinal direction of the casing, may be cylindrical. Thereby, the waist forming the recess could be formed by a part of the casing having a reduced diameter. Thereby, the casing can be made in a lathe to form a turned tube. Thereby, manufacturing of the motor pod is simplified and therefore cheaper. Thus, structurally efficiency is combined with manufacturing advantages.

An axis of rotational symmetry of the casing may be coaxial with the rotational axis of the propeller arrangement. Further, the casing may be cylindrically shaped in the recess.

Preferably, along at least a portion of a circumference of the casing, the extension, in the longitudinal direction of the casing, of the submergible structure, is the same as the extension of the recess in the longitudinal direction of the casing. Thereby, at the ends of the recess in the casing longitudinal direction, the submergible structure may have a delimitation in a radial direction of the casing, which is the same as the delimitation of the casing in the radial direction, immediately outside of the recess. Thereby, a smooth transition of the external surface of the casing to the external surface of the submergible structure may be provided.

The hydrofoil and the further element are preferably releasably fastened to each other. Alternatively, the hydrofoil and the further element may be non-releasably fastened to each other, e.g. by an adhesive or rivets The submergible structure may comprise a hydrofoil holding arrangement. Thereby, the hydrofoil may be mounted to the hull by means of the hydrofoil holding arrangement. The hydrofoil may be a submerged type hydrofoil, or a surface piercing hydrofoil.

The hydrofoil holding arrangement may comprise a strut. Thereby, the hydrofoil may be mounted to the hull by means of the strut. For example, the further element may be a strut. The strut may be arranged to extend at least partly downwards from the hull. The hydrofoil and the motor pod may be at substantially the same position along the strut. Thereby, the wings of the hydrofoil may extend from opposite sides of the motor pod. The wings may be cantilevered. The propeller arrangement may be upstream or downstream of the strut as understood when the boat is travelling forward. I.e. the propeller arrangement may be a pulling or pushing arrangement.

The strut may partly surround the casing. The strut may partly surround the casing in a circumferential direction of the casing. The strut may form a hydrodynamic profile with a chord line. Thereby, a casing longitudinal axis may be substantially parallel with the chord line. The motor pod may be mounted to a lower end of the strut. However, in some embodiments, the motor pod may be mounted above a lower end of the strut.

Where the strut partly surrounds the casing, the hydrofoil may partly surround the casing so that the strut and the hydrofoil together fully surround the casing. Thereby, the hydrofoil may partly surround the casing in a circumferential direction of the casing. The strut and the hydrofoil may be fastened to each other. Thereby, the strut and the hydrofoil may be releasably fastened to each other, e.g. by bolting, or non-releasably, e.g. by an adhesive or rivets.

Preferably, the hydrofoil as well as the further element extend into the recess of the casing. For example, the strut as well as the hydrofoil may extend into the recess of the casing. Thereby, the strut and the hydrofoil may fully surround the casing while extending into the recess of the casing.

In some embodiments, the strut forms a fork, or a partial circle, to partially surround the casing. Thereby, a dividing line between the strut and the hydrofoil may be horizontal, when the boat is floating at rest. However, in some embodiments, the dividing line between the strut and the hydrofoil may be at an angle to horizontal which is greater than zero degrees and less than or equal to 90 degrees.

As suggested, a recess may be provided as a waist in the casing. For fixing the motor pod to the strut, a lower end of the strut may form a partial circle, or a fork, which at least partly surrounds the casing in the waist. The hydrofoil may extend from one foil tip to another foil tip, with the motor pod and the strut between the tips. Thereby, the hydrofoil may be provided as a single component extending between two foil tips. Thereby, the hydrofoil may extend into the recess of the casing. Thereby, the hydrofoil may comprise a curved part for partly surrounding the casing. The strut and the second hydrofoil may be connected, e.g. by bolts or the like releasable fasteners, or an adhesive or other non-releasable fastening means, on opposite sides of the motor pod.

In some embodiments, the further element is a pod securing device that partly surrounds the casing so that the hydrofoil and the pod securing member together fully surround the casing, wherein the hydrofoil and the pod securing member are fastened to each other. The hydrofoil may be mounted to the hull by means of a hydrofoil holding arrangement. However, in some embodiments, the submergible structure does not comprise any hydrofoil holding arrangement. For example, the submergible structure may comprise a surface piercing hydrofoil extending directly from the hull, e.g. partly downward and partly towards, or away from, a symmetry plane of the hull.

Where the submergible structure comprises a strut, the boat may comprise a strut adjustment arrangement arranged to retract the strut from an extended position to a retracted position. However, in some embodiments, the strut is unretractable.

The third aspect of the invention also provides a combination of a motor pod and a submergible structure, for a boat comprising a hull,

- wherein the motor pod is arranged to be mounted to the hull by means of the submergible structure,
- wherein the motor pod comprises a torque generating assembly, and a propeller arrangement arranged to be driven by the torque generating assembly,
- wherein the motor pod further comprises a casing, wherein the torque generating assembly is housed in the casing,
- wherein the casing comprises a recess, and the submergible structure extends into the recess of the casing
- wherein the submergible structure comprises a hydrofoil that partly surrounds the casing, and a further element that partly surrounds the casing so that the further element and the hydrofoil together fully surround the casing, wherein the further element and the hydrofoil are fastened to each other.

The recess may be provided as a waist in the casing. The casing, or one or more parts of the casing, may have a cylindrical shape. Along at least a portion of a circumference of the casing, the extension, in the longitudinal direction of the casing, of the submergible structure, may be the same as the extension of the recess in the longitudinal direction of the casing. The submergible structure may comprise a hydrofoil holding arrangement, wherein the hydrofoil is mounted to the hull by means of the hydrofoil holding arrangement. The hydrofoil holding arrangement may comprise a strut, wherein the hydrofoil and the motor pod are at substantially the same position along the strut. The strut may at least partly surround the casing. The strut as well as the hydrofoil may extend into the recess of the casing.

Further advantages and advantageous features of the invention are disclosed in the following description and in the dependent claims.

BRIEF DESCRIPTION OF THE DRAWINGS

Below, embodiments of the invention will be described with reference to the drawings, in which.

DETAILED DESCRIPTION OF EMBODIMENTS OF THE INVENTION

Figure 1:
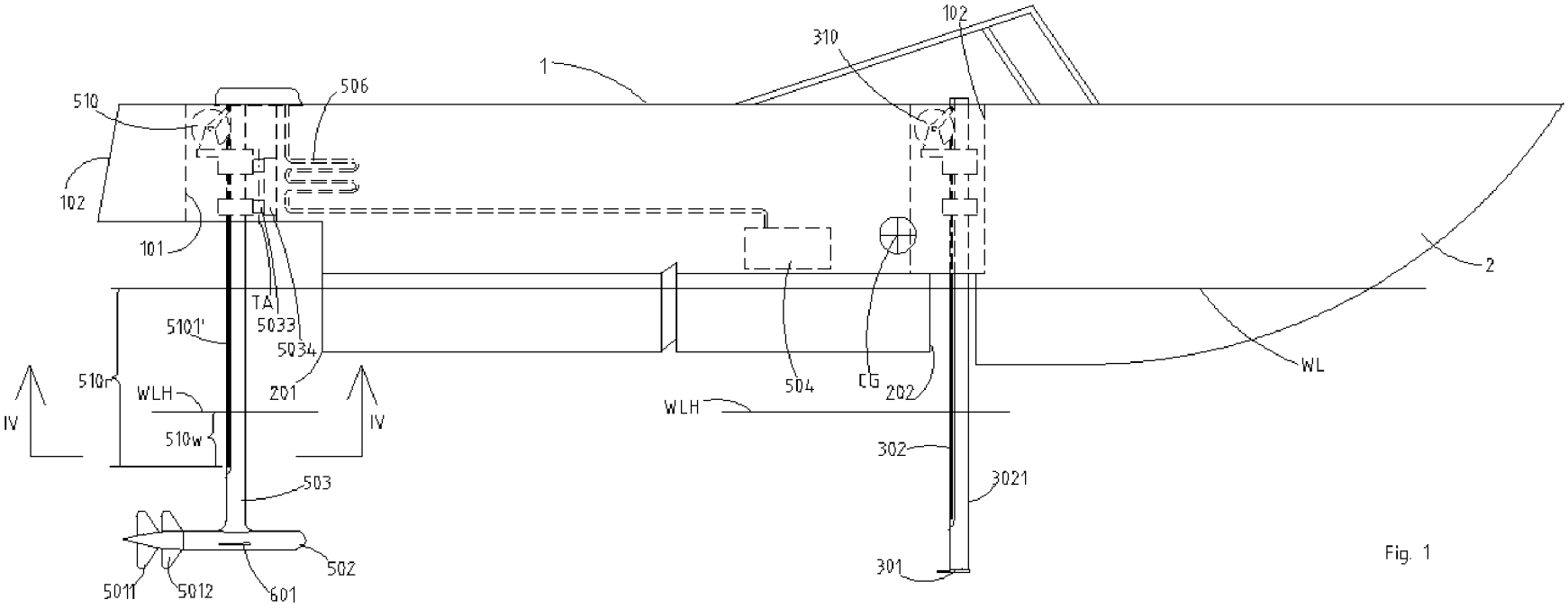
FIG. 1, FIG. 2, and FIG. 5 show side views of a boat according to an embodiment of the invention, with respective hydrofoil configurations, where some hidden parts indicated with broken lines.

FIG. 1 shows a hydrofoil boat 1. The boat comprises a hull 2.

The boat comprises a first submergible structure. The first submergible structure comprises a first hydrofoil 301 and a first hydrofoil holding arrangement 302. The first hydrofoil 301 is mounted to the hull 2 by means of a first hydrofoil holding arrangement 302. The first hydrofoil 301 is a submerged type hydrofoil. The first hydrofoil 301 has an adjustable pitch orientation so as to change the angle of attack of the first hydrofoil. The first hydrofoil 301 is connected to the hull by means of the first hydrofoil holding arrangement 302. The first hydrofoil holding arrangement 302 comprises two struts, herein also referred to a first hydrofoil struts 3021. The first hydrofoil 301 may be in the direction of travel of the boat 1, located close to a center of gravity CG of the boat.

In some embodiments, the boat does not comprise an adjustable hydrofoil. In some embodiments, the boat comprises a surface piercing first hydrofoil.

The boat also comprises a second submergible structure. The second submergible structure comprises a second hydrofoil 601. The second hydrofoil 601 is a submerged type hydrofoil. The second submergible structure further comprises a second hydrofoil holding arrangement comprising a strut 503, herein also referred to as a second hydrofoil strut. The second hydrofoil is mounted to the hull 2 by means of the second hydrofoil holding arrangement. The second hydrofoil strut 503 is separate from the first hydrofoil holding arrangement 302. The second hydrofoil strut is arranged to extend downwards from the hull 2. The second hydrofoil is fixed to a lower end of the second hydrofoil strut.

The second hydrofoil is located behind the first hydrofoil 301 as seen in a direction of straight forward travel of the boat. The second hydrofoil is arranged to support, in a hydrofoil driving mode, an aft part of the hull.

The boat also comprises a motor pod 502, described closer below. The motor pod 502 is fixed to a lower end of the second hydrofoil strut 503. Wings of the second hydrofoil 601 extend on opposite sides from the motor pod as detailed below. The motor pod 502 comprises a torque generating assembly, described below, and a propeller arrangement comprising two counter-rotating propellers 5011, 5012 arranged to be driven by the torque generating assembly.

The second hydrofoil strut 503 holding the motor pod 502 and the second hydrofoil 601 is, by means of a strut turning bearing assembly comprising two strut bearings 5033, pivotally connected to a second hydrofoil strut mounting arrangement 5034 in the form of a bracket fixed to the hull. Thus, in addition to the second hydrofoil strut 503, the second hydrofoil holding arrangement comprises the strut turning bearing assembly 5033 and the strut mounting arrangement 5034. Thereby, the second hydrofoil strut can be turned in relation to the hull around a turning axis TA. An actuator (not shown) is provided to execute the turning.

Where the actuator is a steering wheel of the boat, a suitable linkage may be provided between the steering wheel and the second hydrofoil strut. Thereby, the second hydrofoil strut with the motor pod may be controlled so as to steer the boat.

The second hydrofoil strut 503 extends through the hull at a distance forward of a transom 102 of the boat. For this, the boat is provided with a second hydrofoil strut through opening 101 extending vertically from the bottom of the hull upwards through the boat. The second hydrofoil strut extends through the second hydrofoil strut through opening 101.

As explained below, the boat is adapted to run selectively in a hydrofoil mode or in a planing mode. The hull 2 presents a stern edge 201 arranged so that water with which the hull is in contact in the planing mode of the boat, is released from the hull at the stern edge. The second hydrofoil strut is located behind the stern edge. The hull is shaped so that a part of the hull behind the stern edge 201 is, when the boat is at rest, above the waterline WL.

Further, the boat is provided with two first hydrofoil strut through openings 102 extending vertically from the bottom of the hull upwards through the boat. The first hydrofoil struts 3021 holding the first hydrofoil each extends through a respective of the first hydrofoil strut through openings 102.

The boat comprises an adjustment arrangement 510 for the second hydrofoil strut, as exemplified below. The boat further comprises an adjustment arrangement 310 for the first hydrofoil holding arrangement, as exemplified below.

Figure 2:
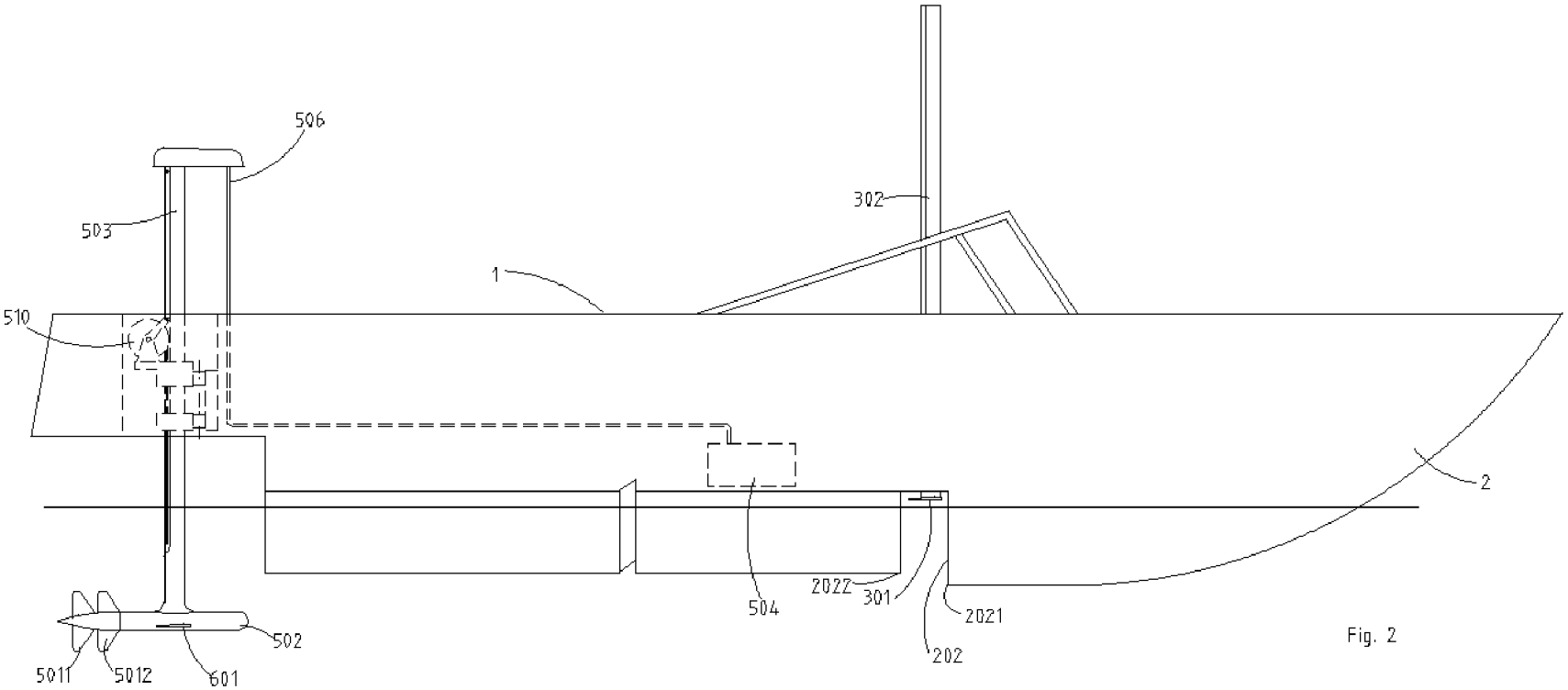

Reference is also made to FIG. 2.

By means of the second hydrofoil strut adjustment arrangement 510 the second hydrofoil strut 503 is arranged to be retracted from an extended position, shown in FIG. 1, to a retracted position, shown in FIG. 2. More specifically, the second hydrofoil strut 503 is arranged to be moved upwards along a longitudinal axis of the second hydrofoil strut. Thereby, the propeller arrangement 5011, 5012, and the second hydrofoil 601, are moved from what is herein referred to as "deployed positions" to "restrained positions". In the deployed positions and in the restrained positions, the propeller arrangement 5011, 5012 and the second hydrofoil 601 are positioned to be submerged in the water carrying the boat. However, the propeller arrangement 5011, 5012 and the second hydrofoil 601 are in the deployed positions, located further down, i.e. deeper in the water, than in the restrained positions. The deployed positions are provided for a hydrofoil mode of the boat, and the restrained positions are provided for a planing mode of the boat.

The propeller arrangement 5011, 5012 and the second hydrofoil 601 are in the retracted position of the second hydrofoil strut, as well as in the extended position of the second hydrofoil strut, located behind the stern edge 201.

As exemplified below, in the extended position as well as in the retracted position, the second hydrofoil strut 503, with the second hydrofoil and the propeller arrangement, is arranged to be turned in relation to the hull so as to steer the boat.

Similarly, by means of the first hydrofoil strut adjustment arrangement 310 the first hydrofoil struts 3021 holding the first hydrofoil 301 are arranged to be retracted from an extended position, shown in FIG. 1, to a retracted position, shown in FIG. 2. More specifically, the first hydrofoil struts 3021 are arranged to be moved upwards along respective longitudinal axes of the first hydrofoil struts 3021. Thereby, the first hydrofoil 301 is moved from what is herein referred to as a "deployed position" to a "restrained position".

In the restrained position, the first hydrofoil is above the water surface when the boat is floating at rest. For this, the hull comprises a recess 202 which is deep enough to allow the first hydrofoil to be moved above the water surface. As indicated in FIG. 2, a forward lower edge 2021 of the recess is lower than a rearward lower edge 2022 of the recess. Thereby, the recess is adapted to form a step in the hull. The step allows air to lubricate the hull when the boat travels in the planing mode.

Figure 3:
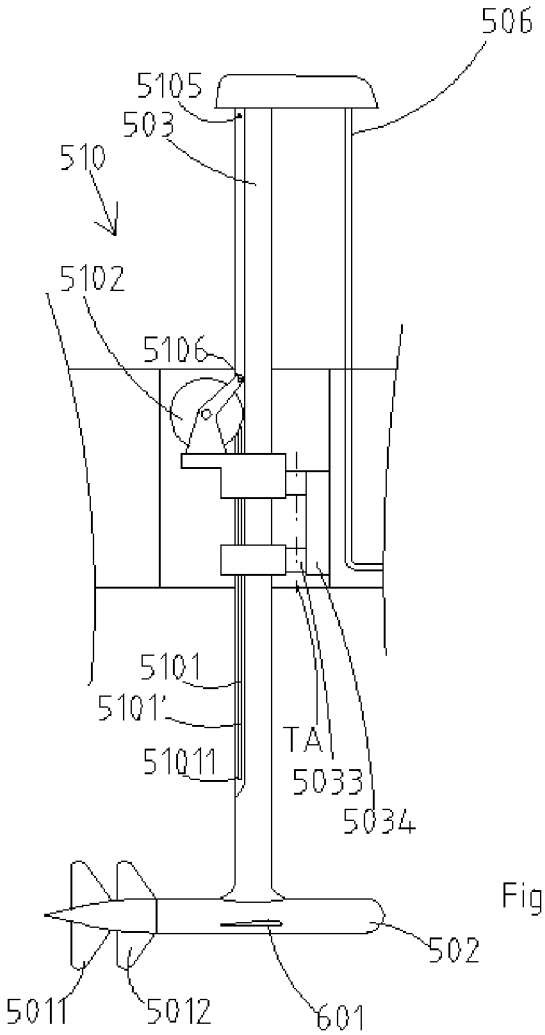
FIG. 3 shows a detail in FIG. 2.

Reference is made also to FIG. 3.

The second hydrofoil strut adjustment arrangement 510 comprises an elongated flexible device 5101 in the form of a rope, wire, or cable. The elongated flexible device 5101 is fastened to the second hydrofoil strut 503. A drum 5102, arranged to be driven by a driving device, such as a motor (not shown), is arranged to reel in the elongated flexible device, to pull up the second hydrofoil strut. The drum 5102 and the driving device forms a winch. It is understood that the elongated flexible device 5101 is fastened to the second hydrofoil strut below the drum 5102. The drum 5102 with the driving device is mounted to a second hydrofoil strut holding assembly 5103. The second hydrofoil strut holding assembly 5103 is arranged to hold the second hydrofoil strut transversally, and to be turnable so as to turn the strut 503, with the propeller arrangement 5011, 5012, for steering of the boat. For this, the second hydrofoil strut holding assembly 5103 is connected to the strut turning bearing assembly 5033.

The second hydrofoil strut extends though the second hydrofoil strut holding assembly 5103. The second hydrofoil strut holding assembly 5103 comprises two strut holding brackets. Thereby, by rotation of the drum 5102, the second hydrofoil strut may be pulled upwards by the elongated flexible device 5101 from the extended position to the retracted position (shown in FIG. 3). The second hydrofoil strut is arranged to be moved from the retracted position to the extended position by gravity only, by rotating the drum in the opposite direction.

Figure 4A:
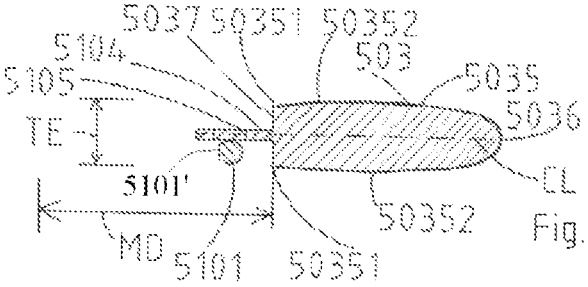
FIG. 4*a* shows a cross-section of a hydrofoil strut of the boat in FIG. 1, oriented as indicated by the arrows IV-IV in FIG. 1, FIG. 4*b*-FIG. 4*g* show cross-sections of hydrofoil struts of boats according to alternative embodiments of the invention.

Reference is made also to FIG. 4*a*.

A major portion of the second hydrofoil strut has a transverse cross-section with a hydrodynamic portion 5035 forming a leading edge 5036 and a blunt trailing edge 5037. The leading edge formed by the hydrodynamic portion is rounded. The blunt trailing edge forms a surface 5037 that is straight and perpendicular to a chord line CL of the hydrodynamic portion 5035. Thereby, as seen in the transverse cross-section of the strut, the surface forming the blunt trailing edge forms sharp corners 50351 with respective side surfaces 50352 of the hydrodynamic portion 5035.

The second hydrofoil strut adjustment arrangement also comprises a locking arrangement for locking the second hydrofoil strut in the retracted position, and in the extended position. The locking arrangement comprises a first engagement device in the form of a locking protrusion 5104 extending from the blunt trailing edge. The locking protrusion 5104 is provided by a ridge raised from the blunt trailing edge and extending along the blunt trailing edge.

The ridge 5104 comprises a plurality of, in this example three, through openings 5105 distributed along the second hydrofoil strut 503. The through openings 5105 are arranged to receive a second engagement device in the form of a male engagement element 5106, indicated in FIG. 3. As also indicated by the reference numeral 51011 in FIG. 3, a lower end of the elongated flexible device 5101 is fastened to the ridge below the through openings 5105. By selectively moving the second hydrofoil strut 503 to align one of the through openings 5105 with the male engagement element 5106, the second hydrofoil strut can be positioned and locked in the extended position, in the retracted position, or in a dry position described below.

In the extended position of the strut, a part 5101' of the elongated flexible device 5101 and the ridge 5104 are located within an extension TE of the surface formed by the blunt trailing edge 5037, which extension is transverse to the chord line CL of the hydrodynamic portion. Further, the elongated flexible device 5101 and the ridge 5104 are entirely within a maximum distance MD from the blunt trailing edge 5037. The maximum distance is the same as the extension of the hydrodynamic portion along the chord line of the hydrodynamic portion.

Thereby, said part 5101' of the elongated flexible device 5101 is arranged to be positioned so as to be located behind the blunt trailing edge as seen in the direction of straight forward travel of the boat. More specifically, said part 5101' of the elongated flexible device 5101 is located behind the blunt trailing edge, as seen in the direction of straight forward travel of the boat, when the strut is in the extended position. However, when the strut is in the retracted position, at least a portion of said part 5101' of the elongated flexible device 5101 is rolled up on the drum 5102 of the winch. In this example, the ridge 5104 is positioned so as to be located behind the blunt trailing edge as seen in the direction of straight forward travel of the boat. This is the position of the ridge regardless of whether the strut is in the retracted or in the extended position. Thereby, the ridge 5104, and said part 5101' of the elongated flexible device 5101 form what is herein referred to as a sheltered portion of the strut adjustment arrangement.

As illustrated in FIG. 1, the sheltered portion of the strut adjustment arrangement may comprise a wet portion 510*w* formed by parts of the strut adjustment arrangement that are arranged to be under the water surface when the boat is travelling in a hydrofoil mode, straight ahead, on flat water, with maximum motor power, and loaded with its maximum weight. Preferably, at the hydrofoil mode, the entire hull is above the surface of the water. In FIG. 1 the water surface in such a hydrofoil mode is indicated as WLH.

The sheltered portion of the strut adjustment arrangement may comprise a rest submerged portion 510*r*, which rest submerged portion is arranged to be under the water surface when the boat is floating at rest in flat water, the strut is in its extended position, and the boat is loaded with its maximum weight. In FIG. 1 the water surface in such conditions is indicated as WLH.

As indicated in FIG. 1 and FIG. 2, the first hydrofoil strut adjustment arrangement 310 is similar to the second hydrofoil strut adjustment arrangement 510. I.e. by means of an elongated flexible device for each first hydrofoil strut 302, in the form of a rope, wire, or cable, and a winch, the first hydrofoil struts may be pulled upwards by the elongated flexible device 5101 from the extended position to the retracted position. A locking arrangement is arranged to lock the first hydrofoil struts in the extended position or in the retracted position.

Similarly to the second hydrofoil strut, each first hydrofoil strut may have a hydrodynamic portion forming, in a transverse cross-section of the strut, a rounded or pointed leading edge and a blunt trailing edge. Thereby, a part the elongated flexible device is arranged to be positioned so as to be located behind the blunt trailing edge as seen in the direction of straight forward travel of the boat. The locking arrangement comprises a first engagement device on the blunt trailing edge, and a second engagement arranged to engage with the first engagement device to selectively lock the first hydrofoil struts in the extended position, or in the retracted position. Thereby, the first engagement device of the locking arrangement and said part of the elongated flexible device form what is herein referred to as a sheltered portion of the first hydrofoil strut adjustment arrangement 310.

Figure 4B:
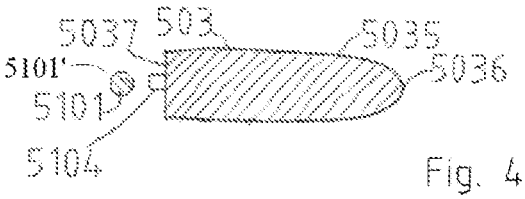

FIG. 4*b* depicts an alternative locking arrangement. The locking arrangement comprises three first engagement devices in the form of locking protrusions 5104 extending from the blunt trailing edge 5037. The locking protrusions 5104 are provided in the form of studs, each arranged to engage a recess of a second engagement device (not shown). The second engagement device is movable towards and away from a locking protrusion 5104 positioned at the second engagement device. Thereby, the locking protrusions 5104 and a part of the elongated flexible device and form what is herein referred to as a sheltered portion of the strut adjustment arrangement.

Figure 4C:
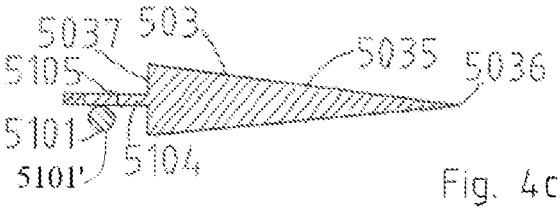

FIG. 4*c* depicts an alternative strut cross-section. The hydrodynamic portion 5035 thereof has a pointed leading edge 5036. With the blunt trailing edge 5037 the hydrodynamic portion forms a supercavitating profile. Similar to what is shown in FIG. 4*a*, a part of an elongated flexible device 5101 for retracting the strut is arranged to be positioned so as to be located behind the blunt trailing edge 5037 as seen in the direction of straight forward travel of the boat. Also similar to what is shown in FIG. 4*a*, a locking protrusion 5104 is provided by a ridge extending along the blunt trailing edge, and thereby, the locking protrusion 5104 is positioned so as to be located behind the blunt trailing edge 5037 as seen in the direction of straight forward travel of the boat. Thereby, the locking protrusion 5104 and said part of the elongated flexible device and form what is herein referred to as a sheltered portion of the strut adjustment arrangement.

Figure 4D:
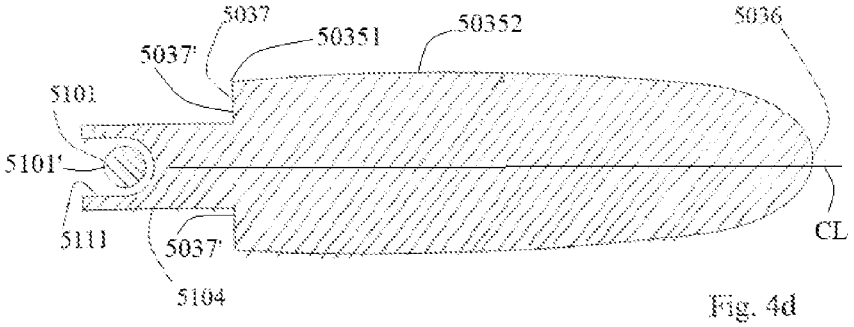

Reference is made to FIG. 4*d*, showing a further alternative, which is similar to the one shown in FIG. 4*a*, except for the following. The ridge 5104 presents a cavity 5111 extending along the strut. The cavity 5111 opens backwards. The cavity 5111 opens in a rearward facing surface of the ridge.

A part of the elongated flexible device 5101 of the second hydrofoil strut adjustment arrangement is arranged to be positioned within the cavity 5111 on the ridge. Thereby, said part of the elongated flexible device 5101 and the ridge form a sheltered portion of the strut adjustment arrangement, which is positioned, and arranged to be positioned, so as to be located behind the blunt trailing edge 5037 as seen in the direction of straight forward travel of the boat.

As can be seen in FIG. 4*d*, two surfaces 5037' form the blunt trailing edge 5037. The blunt trailing edge surfaces 5037' are distributed on opposite sides of the ridge 5104. The blunt trailing edge surfaces 5037' are perpendicular to the chord line CL of the hydrodynamic portion. The blunt trailing edge surfaces 5037' form corners 50351 with respective side surfaces 50352 of the hydrodynamic portion. The corners are sharp. Thus, they have small radii, e.g. less than 1/10 of the width of the blunt trailing edge.

Figure 4E:
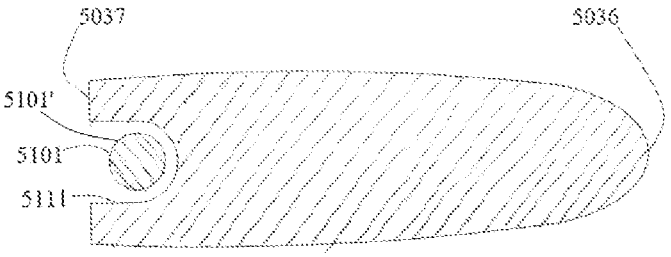

Reference is made to FIG. 4*e*, showing another alternative, which is similar to the one shown in FIG. 4*d*, except for the following. The blunt trailing edge 5037 presents a cavity 5111 extending along the strut. The cavity 5111 opens backwards. The cavity 5111 extends from the blunt trailing edge.

A part of the elongated flexible device 5101 of the second hydrofoil strut adjustment arrangement is arranged to be positioned within the cavity 5111 on the blunt trailing edge 5037. Thereby, said part of the elongated flexible device 5101 forms at least a part of a sheltered portion of the strut adjustment arrangement, which is arranged to be positioned in the cavity 5111.

Figure 4F:
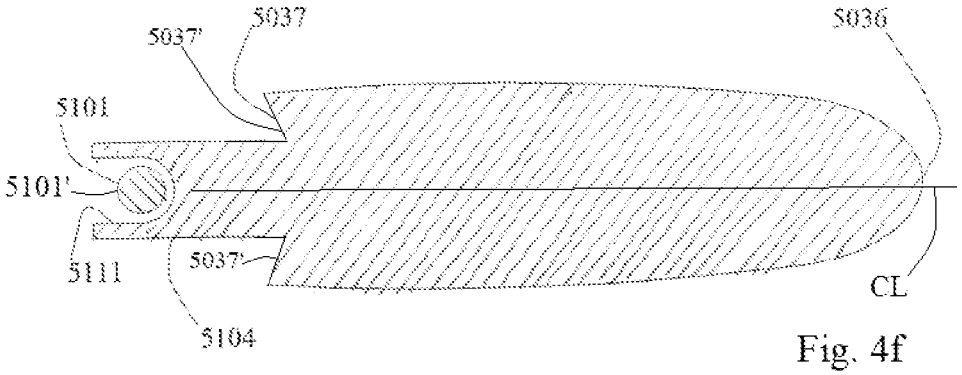

Reference is made to FIG. 4*f*, showing an example similar to the one in FIG. 4*d*, but with the following difference: The blunt trailing edge surfaces 5037' are angled so as to partly face towards the chord line CL of the hydrodynamic portion.

Figure 4G:
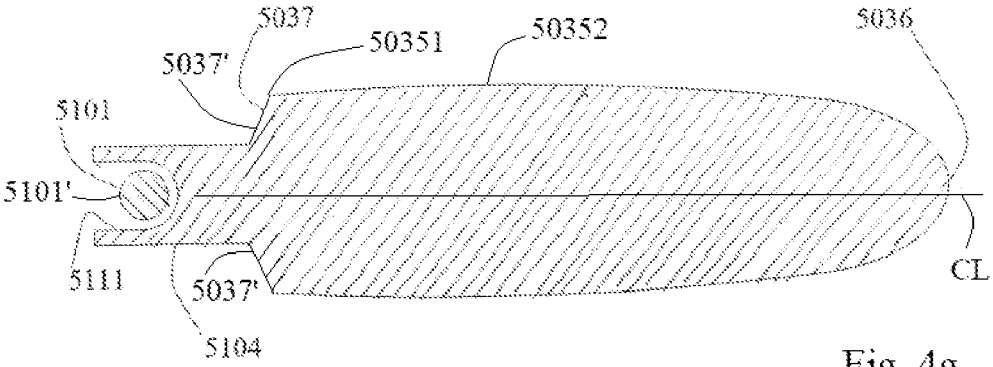

Reference is made to FIG. 4*g*, showing an example similar to the one in FIG. 4*d*, but with the following difference: The blunt trailing edge surfaces 5037' are angled so as to partly face away from the chord line CL of the hydrodynamic portion.

Figure 5:
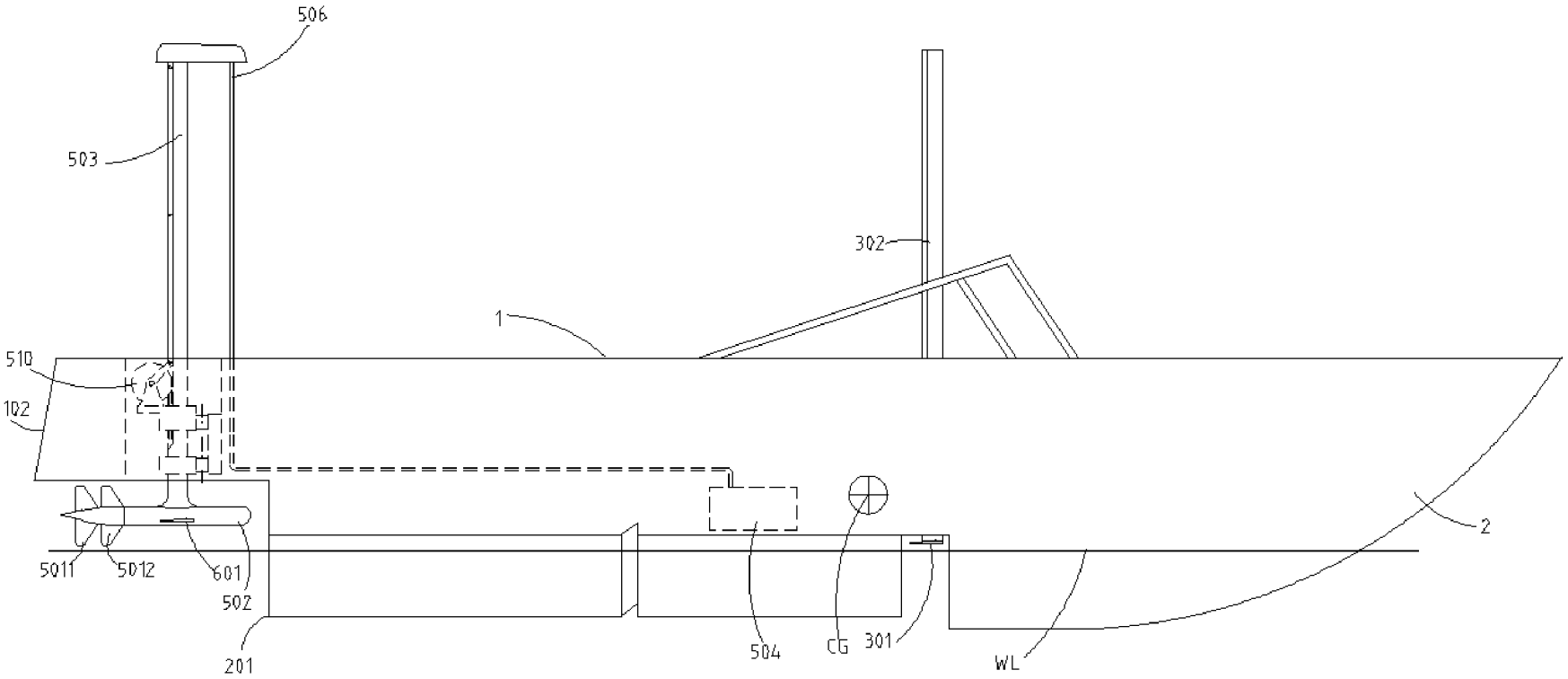
Figure 6:
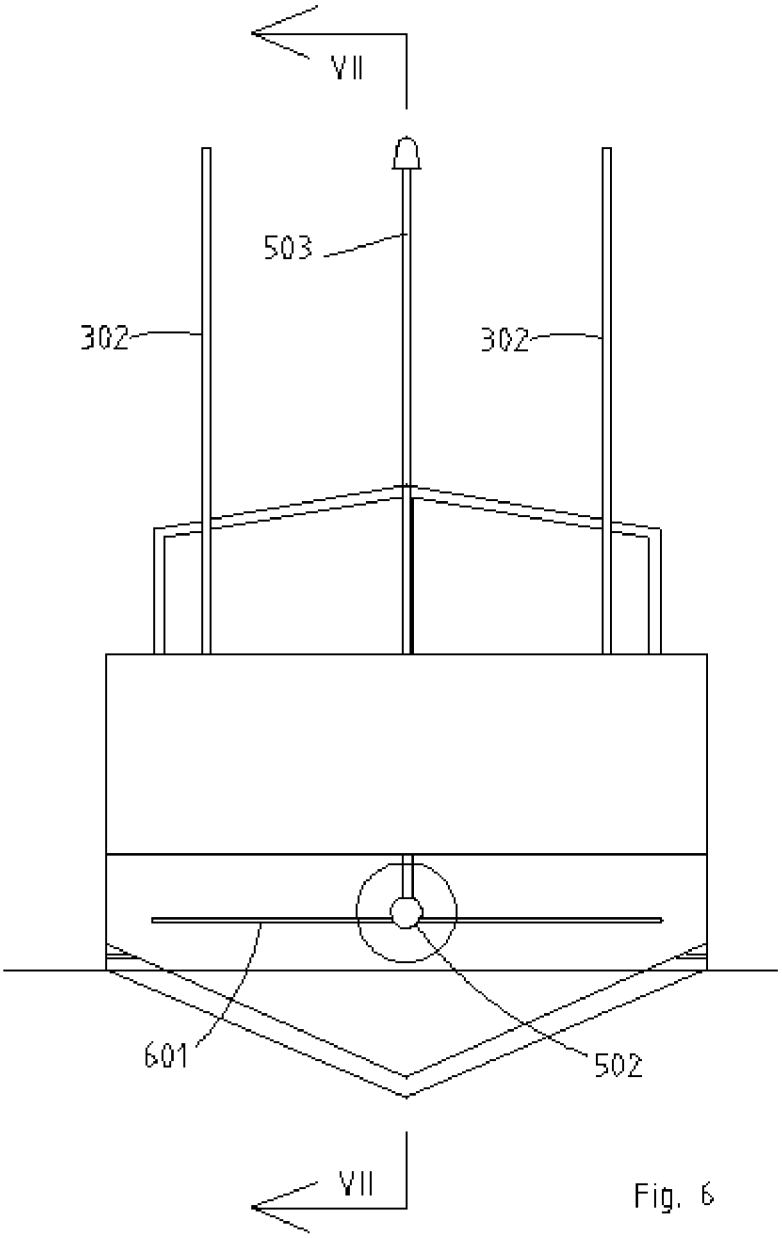
FIG. 6 shows the boat with the hydrofoil configuration in FIG. 5, as seen from behind.

Reference is made also to FIG. 5 and FIG. 6. By means of the second hydrofoil strut adjustment arrangement, the second hydrofoil strut 503 is arranged to be retracted from the retracted position to the dry position in which the propeller arrangement 5011, 5012 and the second hydrofoil 601 are above the water surface when the boat is floating at rest. Thereby the propeller arrangement 5011, 5012 and the second hydrofoil 601 are located behind the stern edge 201. More specifically, the propeller arrangement 5011, 5012 and the second hydrofoil 601 are located between the transom 102 and the stern edge 201. Thereby fouling of the propeller arrangement and the second hydrofoil can be avoided.

Figure 7:
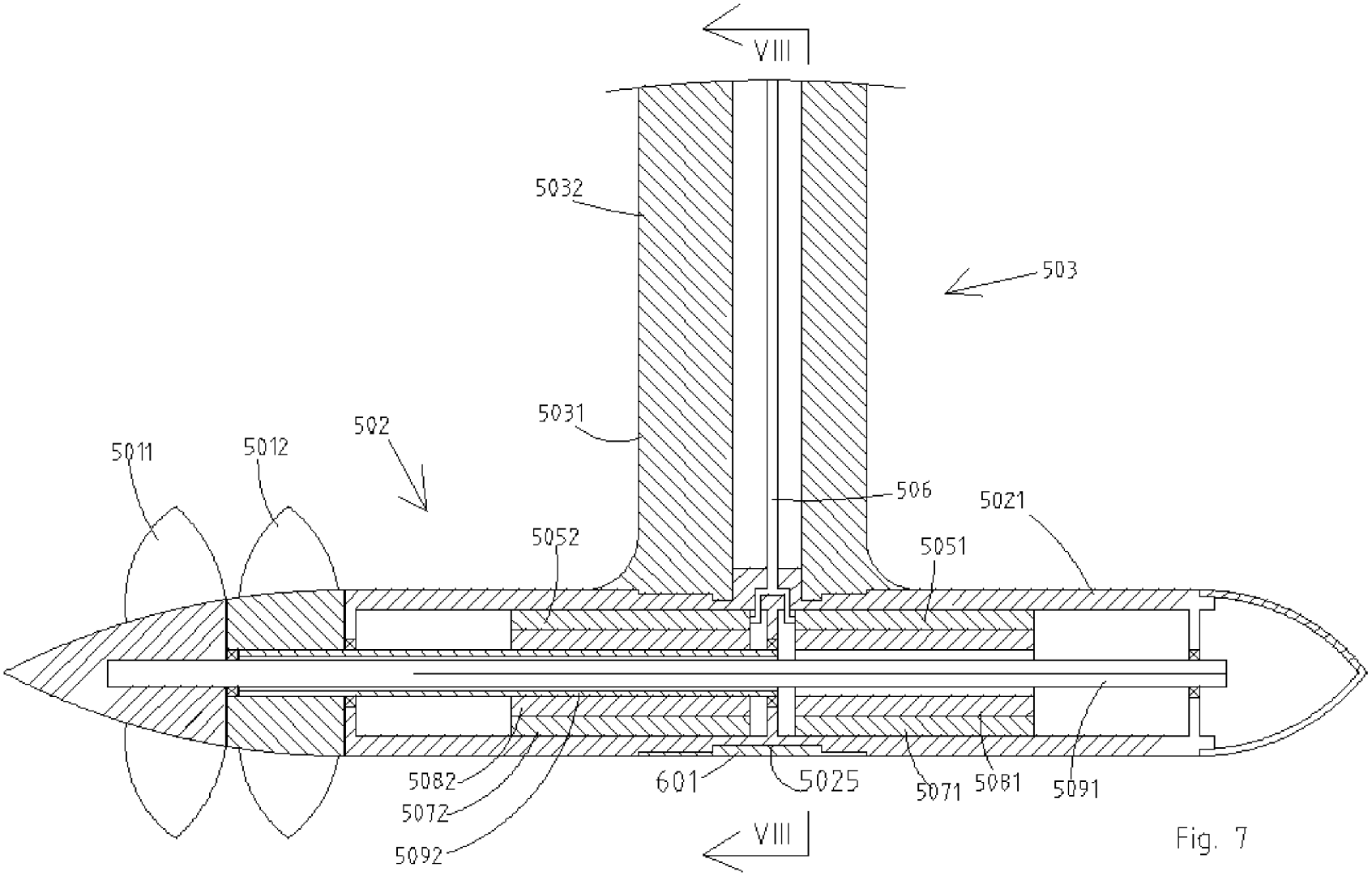
FIG. 7 shows a cross-section of a motor pod, a part of a strut, and propellers, as indicated by the arrows VII-VII in FIG. 6.

Reference is made also to FIG. 7. The motor pod comprises a casing 5021. The casing has an elongated shape. The casing has a cylindrical outer surface. The casing may be made in a metal, e.g. bronze or stainless steel. The casing may be formed by lathing.

The torque generating assembly comprises two electric motors 5051, 5052. The motors are housed coaxially in the casing. The two propellers 5011, 5012 are each arranged to be driven by a respective of the motors. As suggested, the propellers 5011, 5012 are counter-rotating, located behind the motors, as seen in a direction of straight forward travel of the boat. The propellers comprise blades which are mounted on propeller hubs.

Each motor comprises a stator 5071, 5072. The stator is fixed to an inner surface of the casing 5021. Each motor also comprises a rotor 5081, 5082, fixed to a respective of two propeller shafts, 5091, 5092. An inner shaft 5091 of the shafts connects a forward motor 5051 of the motors to an aft propeller 5011 of the propellers. An outer shaft 5092 of the shafts connects a rear motor 5051 of the motors to a forward propeller 5011 of the propellers. The inner shaft 5091 extends through the outer shaft 5092.

The motors 5051, 5052 are arranged to be powered by a power source such as a battery pack 504, as exemplified in FIG. 1, FIG. 2, and FIG. 5. In this embodiment, the power source 504 is located in the hull 2 of the boat. As indicated in FIG. 1, FIG. 2, FIG. 5, and FIG. 7, one or more electric cables 506 are provided for the delivery of power from the power source 504 to the torque generating assembly 5051, 5052. The one or more cables 506 extend through the second hydrofoil strut 503. The one or more cables 506 are preferably flexible. Thereby the cable(s) may flex while the second hydrofoil strut is moved to and from the retracted position. In this embodiment, the cable(s) 506 enter the strut 503 at a top end of the second hydrofoil strut. Thereby, as exemplified in FIG. 1, FIG. 2, FIG. 5, a surplus of cable length is provided in the hull, so as for the second hydrofoil strut to be allowed to be lifted while being retracted, the cable(s) thereby being fed so as to adjust to the raised second hydrofoil strut.

It is understood that the boat also comprises wiring for the control of the motors. Such wiring may also extend through the second hydrofoil strut, similarly to said cables.

Figure 8:
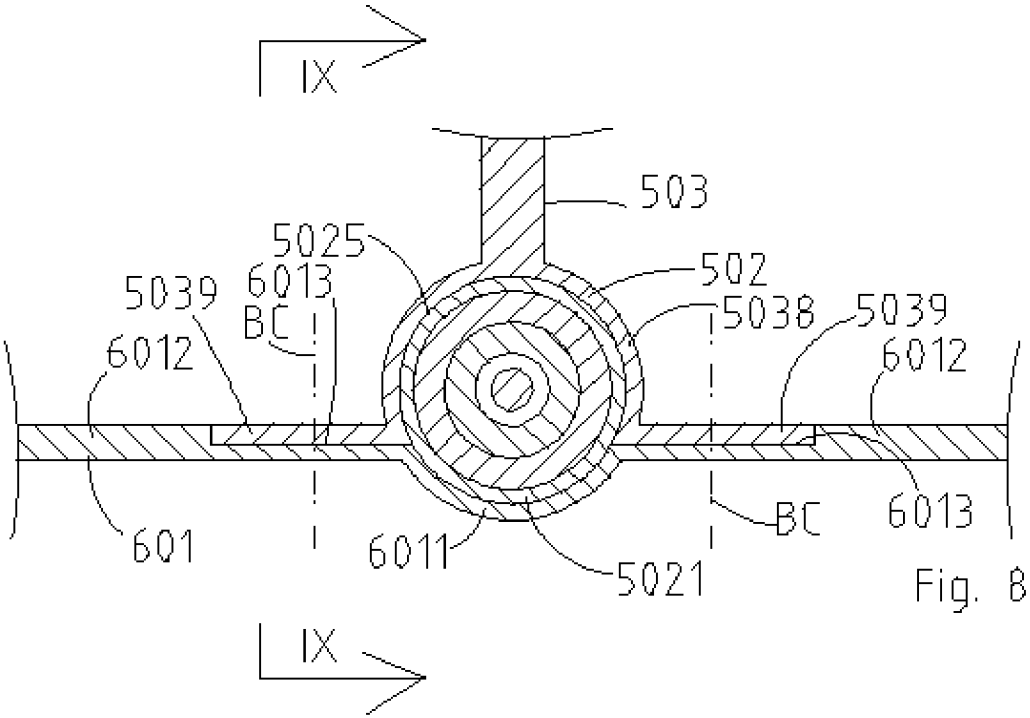
FIG. 8 shows a cross-section of the motor pod, a part of the strut, and a part of a hydrofoil, as indicated by the arrows VIII-VIII in FIG. 7.

Reference is made also to FIG. 8. As suggested, wings of the second hydrofoil 601 extend from opposite sides of the motor pod 502.

As indicated in FIG. 7, as external surface of the casing 5021 comprises a recess 5025. The recess extends in a longitudinal direction of the casing, throughout a central part of the casing. The recess extends in a circumferential direction of the casing. Generally, the recess may extend at least through half of the circumference of the casing. In this example, the recess 5025 extends through the entire circumference of the casing. The recess is provided as a waist in the casing.

The strut 503 and the second hydrofoil 601 extend into the recess 5025. As indicated in FIG. 8, for fixing the motor pod 502 to the strut 503, the lower end of the strut forms a fork 5038 which partly surrounds the casing in the recess.

The second hydrofoil 601 is provided as a single component extending between two foil tips. Thereby, the hydrofoil 601 extends into the recess 5025 of the casing. Thereby, the submergible structure formed by the second hydrofoil strut 503 and the second hydrofoil 601 extends into the recess of the casing.

The hydrofoil comprises a curved part 6011 partly surrounding the casing in the recess. The curved part 6011 connects the wings 6012 of the hydrofoil. Thereby, the strut 503 and the hydrofoil 601 together fully surround the casing.

The second hydrofoil strut 503 and the second hydrofoil 601 are connected on opposite sides of the motor pod 502, by bolts as indicated in FIG. 8 by the lines BC. More specifically, from ends of the fork 5038, connection ears 5039 extend each in the direction of a respective of the wings 6012. The ears 5039 are fitted in recesses 6013 in the wings 6012. The bolt connections BC extend through the ears 5039 and the recessed portions of the wings 6012.

Thereby, the strut 503 locks, by means of the recess 5025 in the casing, the casing in the longitudinal direction of the motor pod, i.e. along the axes of the propellers. Further, the second hydrofoil 601 is, by means of the recess 5025 in the casing, locked in the longitudinal direction of the motor pod. Thereby, the second hydrofoil 601 provides the function of a pod securing member, which together with the strut 503 secures the motor pod to the strut.

Figure 9:
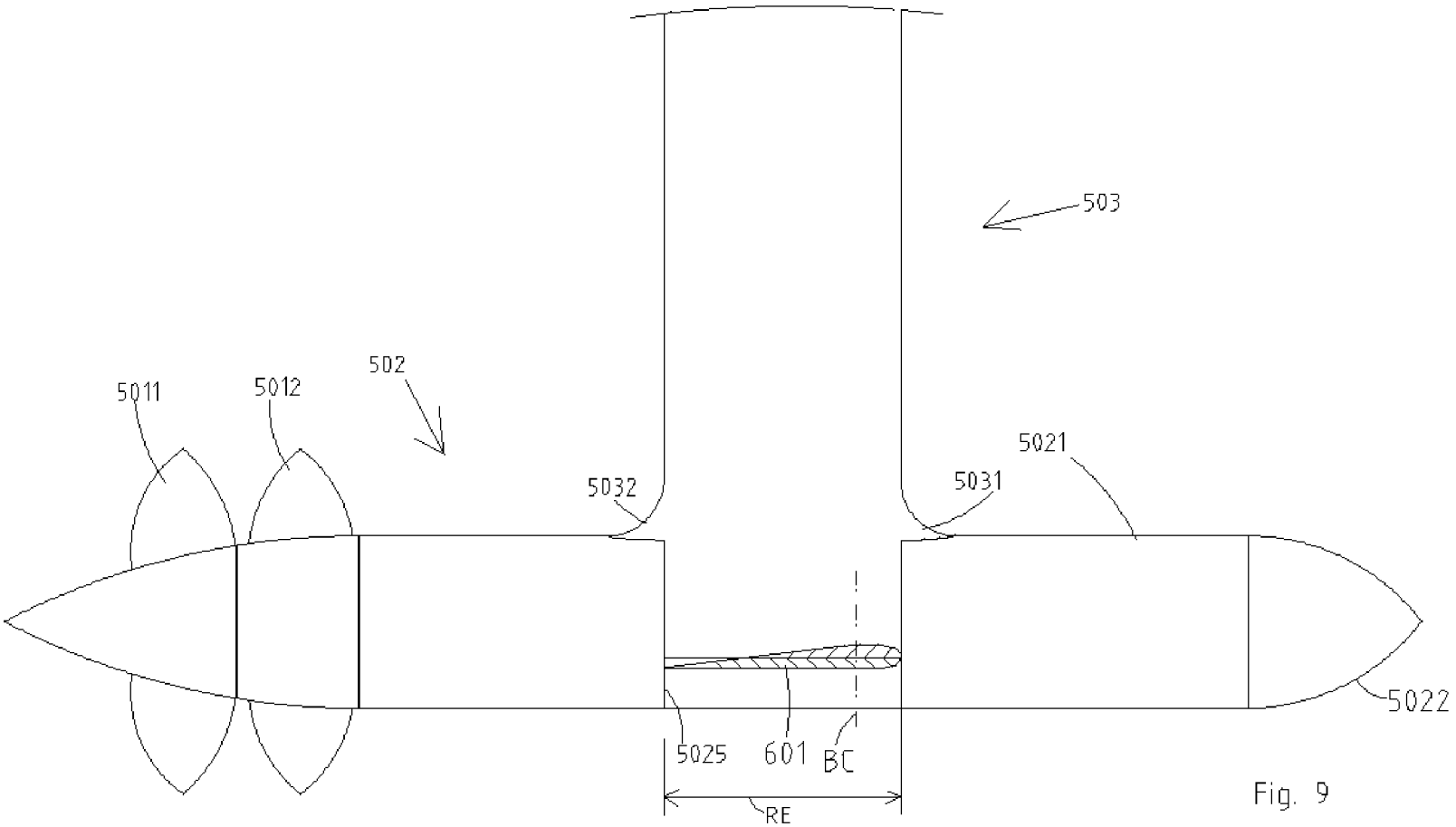
FIG. 9 shows a cross-sectional view as indicated by the arrows IX-IX in FIG. 8.

Reference is made also to FIG. 9. As exemplified in FIG. 9, the motor pod comprises a nose cone 5022, located adjacent the casing 5021. The casing 5025 extends in its longitudinal direction from the propeller arrangement 5011, 5012 to the nose cone 5022.

At the motor pod, the strut presents leading edge, and trailing edge extensions 5031, 5032 which extend over the casing 5021. The extensions 5031, 5032 have lateral extensions, and therefore they extend over respective portions of the circumference of the casing.

Along a remaining portion of the casing circumference, over which the extensions 5031, 5032 do not extend, the extension in the longitudinal direction of the casing, of the strut 503 and the hydrofoil 601, is the same as the extension RE of the recess 5025 in the longitudinal direction of the casing. Thereby, at ends of the recess in the casing longitudinal direction, the strut 503 and the hydrofoil 601 have delimitations in a radial direction of the casing, which is the same as the delimitation of the casing in the radial direction, immediately outside of the recess. Thereby, smooth transitions of the external surface of the casing to the external surfaces of the strut 503 and the hydrofoil 601 are provided.

Figure 10:
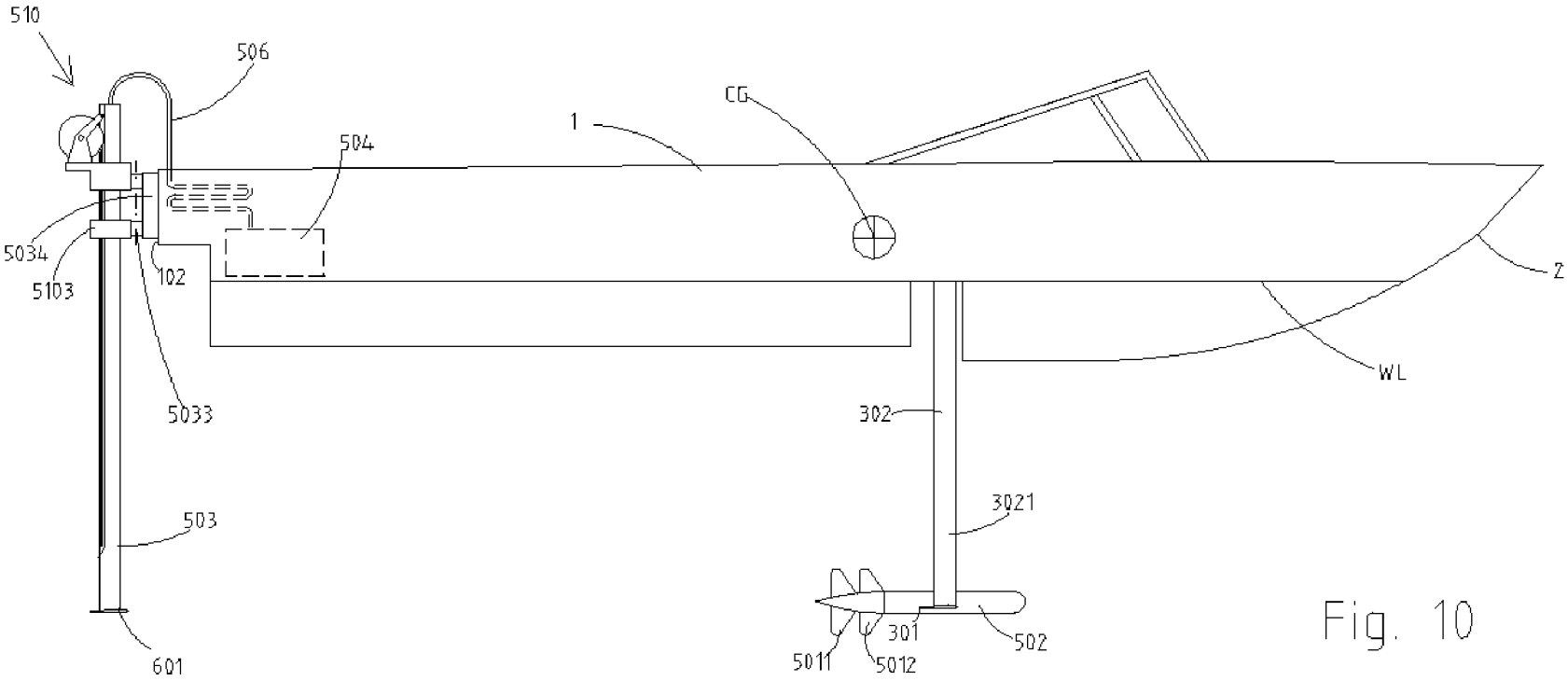
FIG. 10 shows a side view of a boat according to another embodiment of the invention.
Figure 11:
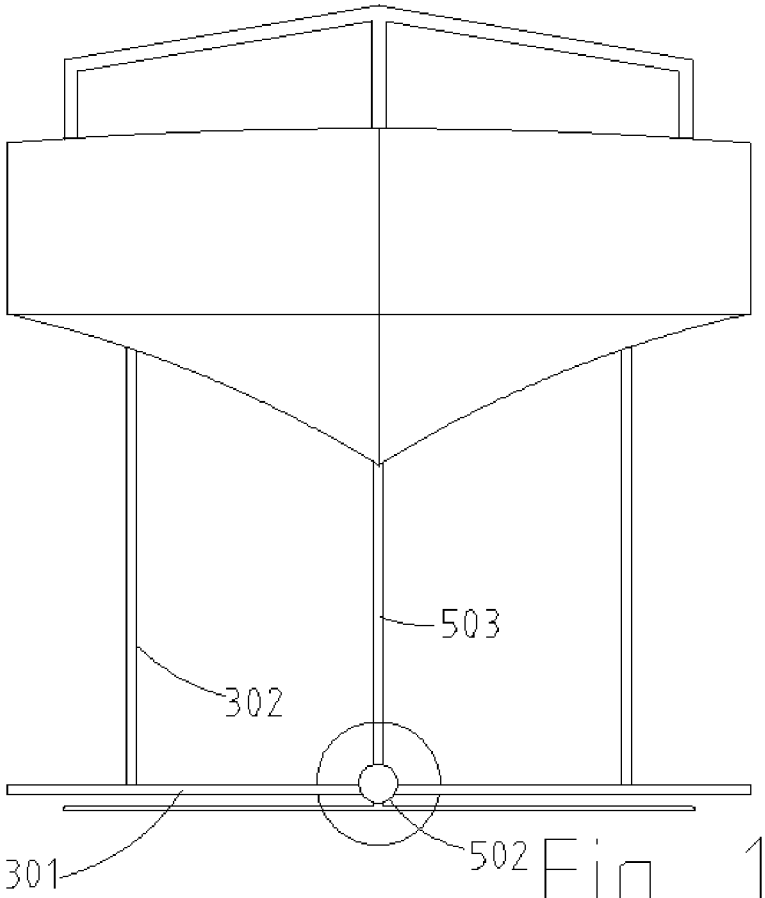
FIG. 11 shows the boat in FIG. 10, as seen from in front of the boat.
Figure 12:
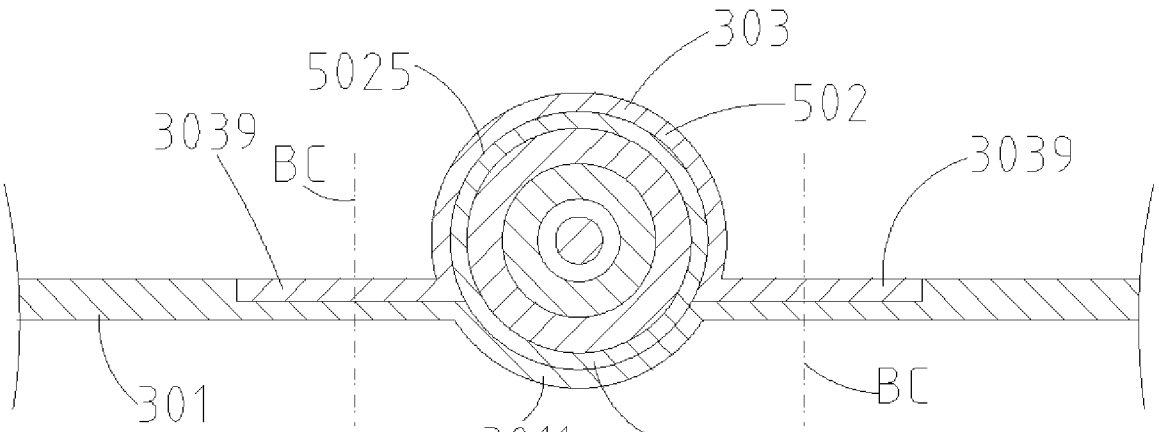
FIG. 12 shows a cross-section, similar to the cross-section of FIG. 8, of a motor pod, a part of hydrofoil, and a part of a pod securing member, of the boat in FIG. 10 and FIG. 11.

FIG. 10-FIG. 12 depicts a boat according to an alternative embodiment of the invention. Similarly to the boat described with reference to FIG. 1-FIG. 8, the boat comprises a first hydrofoil 301 mounted to a hull 2 by means of a first hydrofoil holding arrangement 302 comprising two first hydrofoil struts 3021. The boat also comprises a second hydrofoil 601, mounted to the hull 2 by means of a second hydrofoil holding arrangement comprising a second hydrofoil strut 503. The second hydrofoil strut 503 is by means of a strut turning bearing assembly 5033, pivotally connected to a strut mounting arrangement 5034 fixed to the hull, whereby the strut can be turned in relation to the hull around a turning axis.

Unlike the boat in FIG. 1-FIG. 8, the second hydrofoil strut 503 extends behind the transom 102 of the boat. The boat comprises a second hydrofoil strut adjustment arrangement 510 for the second hydrofoil strut 503. The second hydrofoil adjustment arrangement 510 comprises a second hydrofoil strut holding assembly 5103. The boat also comprises a first hydrofoil strut adjustment arrangement (not shown) for the first hydrofoil struts.

Similarly to that described above, by means of the second hydrofoil strut adjustment arrangement 510 the second hydrofoil strut 503 is arranged to be retracted from an extended position, shown in FIG. 10 and FIG. 11, to a retracted position. Also the first hydrofoil struts 3021 are arranged to be retracted from an extended position, shown in FIG. 10 and FIG. 11. Thereby, the first hydrofoil, the propeller arrangement 5011, 5012, and the second hydrofoil 601, are moved from deployed positions to restrained positions.

The deployed positions are provided for a hydrofoil mode of the boat, and the restrained positions are provided for a planing mode of the boat. In the extended position as well as in the retracted position, the second hydrofoil strut 503, with the second hydrofoil, is arranged to be turned in relation to the hull so as to steer the boat.

Similarly to the boat in FIG. 1-FIG. 8, the boat comprises a motor pod 502. Differing from the boat in FIG. 1-FIG. 8, the motor pod 502 is fixed to the first hydrofoil 301. Thereby, wings of the first hydrofoil 301 extend on opposite sides from the motor pod.

As can be seen in FIG. 12, the first hydrofoil 301 comprises a curved part 3011 partly surrounding the casing 5021 in a recess 5025 of the casing. The curved part 3011 connects the wings of the hydrofoil. A pod securing member 303 surrounds the remainder of the casing circumference while extending into the recess 5025. Thereby, the pod securing member 303 and the hydrofoil 301 together fully surround the casing.

The pod securing member 303 and the hydrofoil 301 are connected on opposite sides of the motor pod 502, by bolts as indicated in FIG. 12 by the lines BC. More specifically, from ends of the pod securing member 303, connection ears 3039 extend each in the direction of a respective one of the hydrofoil wings. The ears 5039 are fitted in recesses in the wings. The bolt connections BC extend through the ears 5039 and the recessed portions of the wings.

Figure 13:
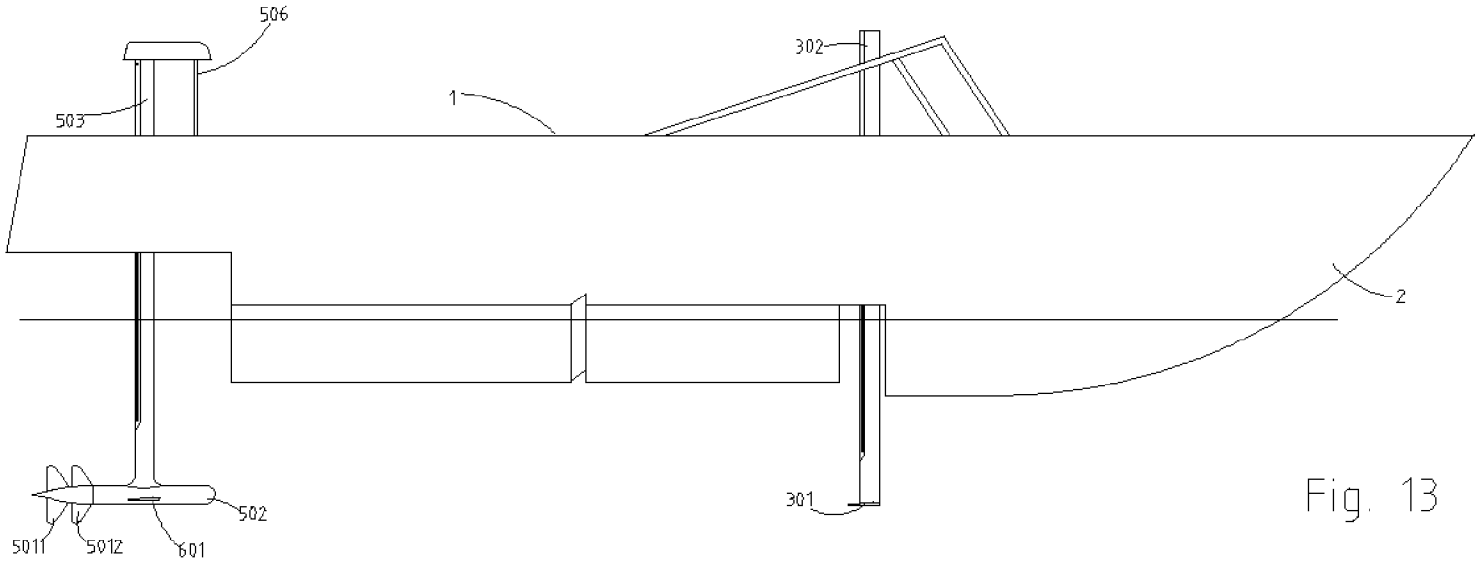
FIG. 13 shows a side view of a boat according to an alternative embodiment of the invention, with a hydrofoil configuration for a semi-foiling mode.

Reference is made to FIG. 13. In this embodiment, the first hydrofoil 301 may be in a first restrained position, shown in FIG. 13, in which it is partially deployed and arranged to be submerged. Further, the second hydrofoil 601 is also in a first restrained position in which it is partially deployed and arranged to be submerged. The first restrained positions of the first and second hydrofoils 301, 601 are used for a semi-foiling mode of the boat. In the semi-foiling mode, the hydrofoils may create lift to reduce the friction of the hull against the water. The semi-foiling mode may be useful in rough seas.

The first and second hydrofoils may be moved to respective second restrained positions, e.g. as shown in FIG. 2. The second restrained positions may be used for a planing mode. Thereby, the first hydrofoil is removed from the water passing the hull during travel. Further, in the second restrained position, the second hydrofoil is still submerged, but above the first restrained position.

Figure 14:
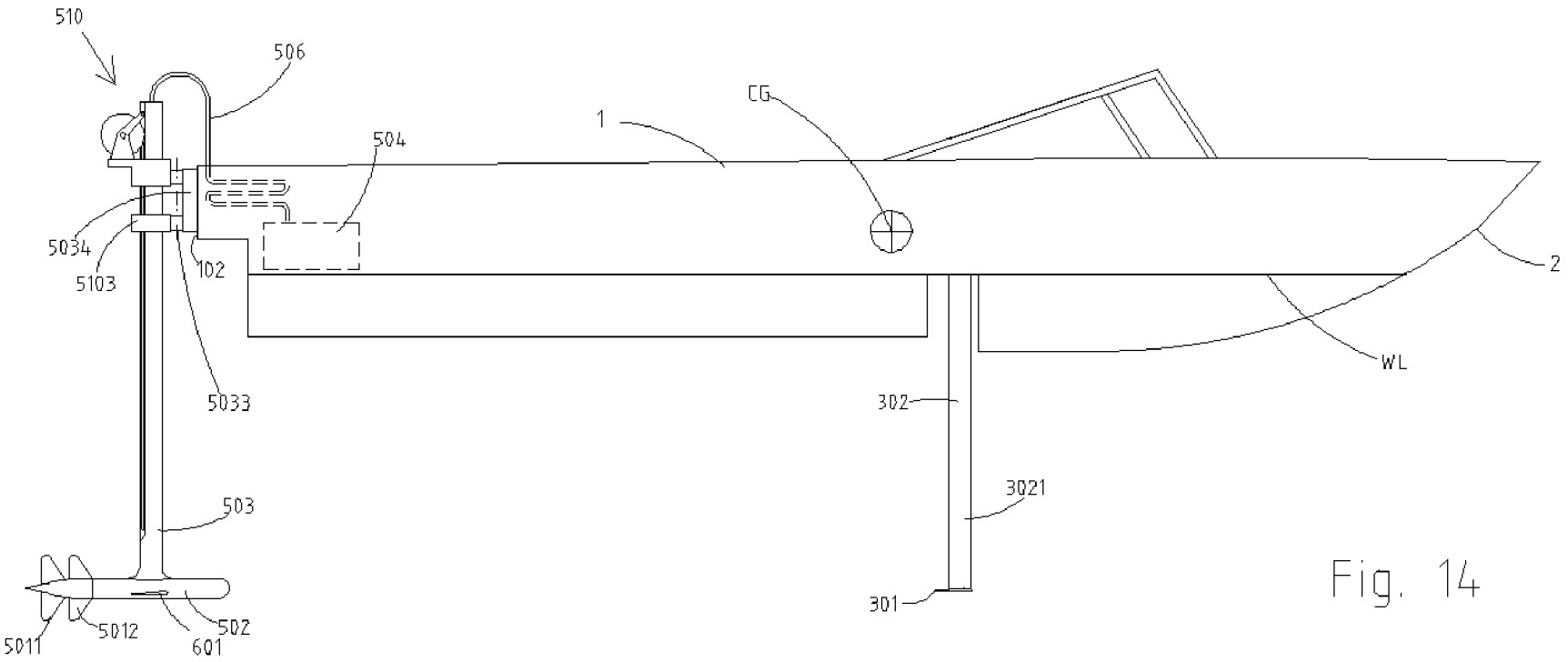
FIG. 14, and FIG. 16 show side views of a boat according to another embodiment of the invention, with respective hydrofoil configurations.
Figure 15:
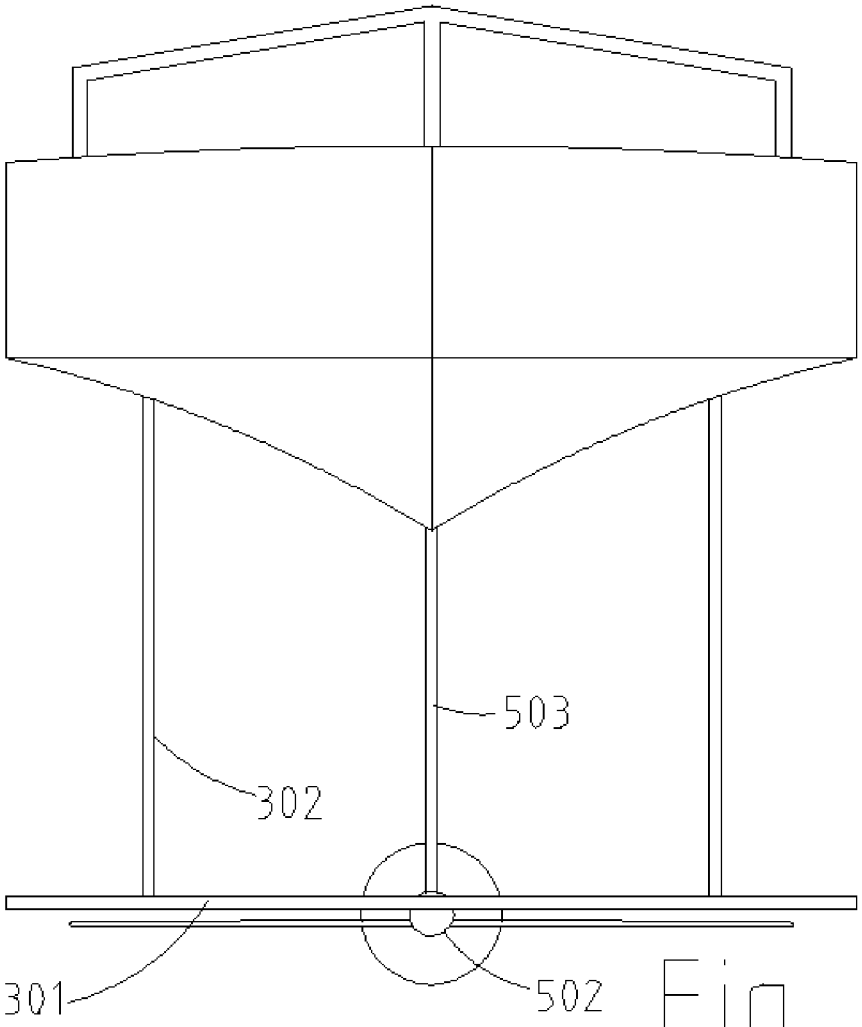
FIG. 15 shows the boat with the hydrofoil configuration in FIG. 14, as seen from in front of the boat.
Figure 16:
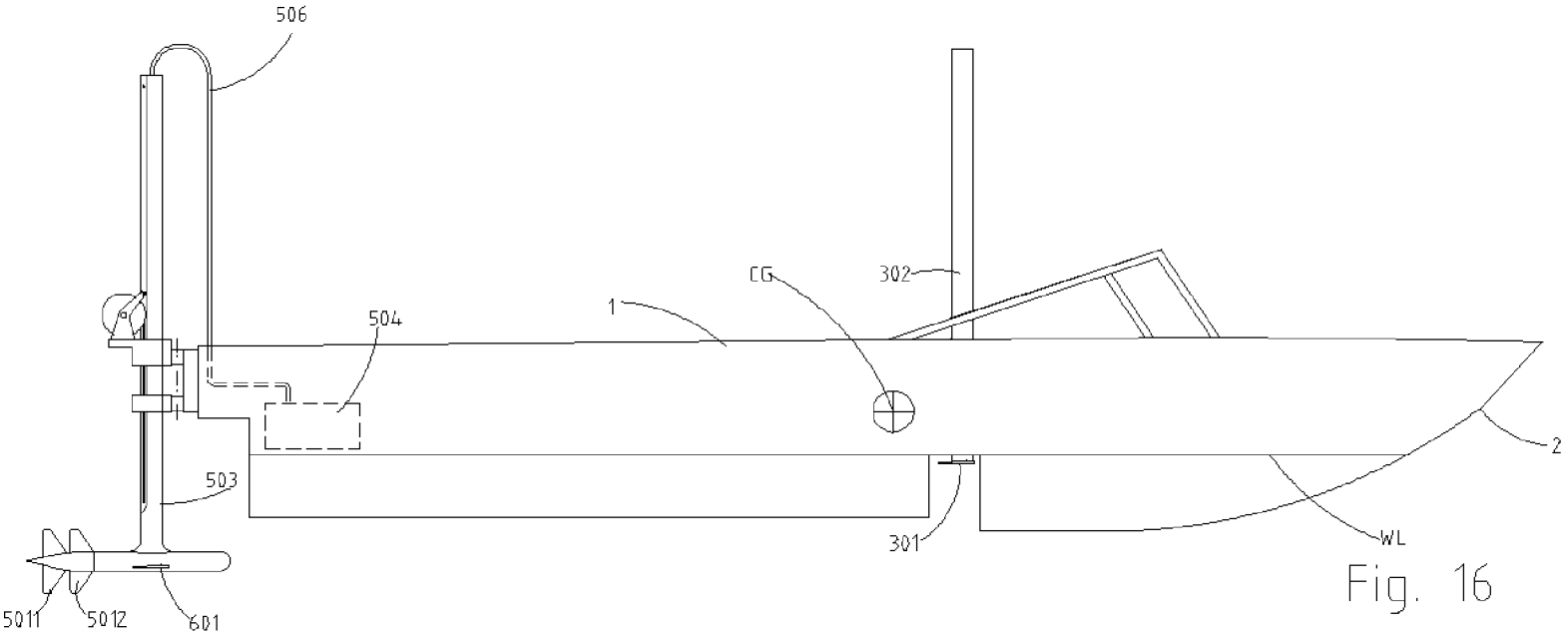

FIG. 14-FIG. 16 depicts a boat according to an alternative embodiment of the invention. Similarly to the boat described with reference to FIG. 1-FIG. 8, the boat comprises a first hydrofoil 301 mounted to a hull 2 by means of a first hydrofoil holding arrangement 302 comprising two first hydrofoil struts 3021. The boat also comprises a second hydrofoil 601, mounted to the hull 2 by means of a second hydrofoil holding arrangement comprising a second hydrofoil strut 503. The boat also comprises a motor pod 502, fixed to a lower end of the second hydrofoil strut 503. Wings of the second hydrofoil 601 extend on opposite sides from the motor pod. The motor pod 502 comprises a torque generating assembly, and a propeller arrangement comprising two counter-rotating propellers 5011, 5012. The second hydrofoil strut 503 is by means of a strut turning bearing assembly 5033, pivotally connected to a strut mounting arrangement 5034 fixed to the hull, whereby the strut can be turned in relation to the hull around a turning axis.

Differing from the boat in FIG. 1-FIG. 8, the second hydrofoil strut 503 extends behind the transom 102 of the boat. The boat comprises a second hydrofoil strut adjustment arrangement 510 for the second hydrofoil strut 503. The second hydrofoil adjustment arrangement 510 comprises a second hydrofoil strut holding assembly 5103. The boat also comprises a first hydrofoil strut adjustment arrangement (not shown) for the first hydrofoil struts.

Similarly to that described above, by means of the second hydrofoil strut adjustment arrangement 510 the second hydrofoil strut 503 is arranged to be retracted from an extended position, shown in FIG. 14 and FIG. 15, to a retracted position, shown in FIG. 16. Also, the first hydrofoil struts 3021 are arranged to be retracted from an extended position, shown in FIG. 14 and FIG. 15, to a retracted position, shown in FIG. 16. Thereby, the first hydrofoil, the propeller arrangement 5011, 5012, and the second hydrofoil 601, are moved from deployed positions to restrained positions.

The deployed positions are provided for a hydrofoil mode of the boat, and the restrained positions are provided for a planing mode of the boat. In the extended position as well as in the retracted position, the second hydrofoil strut 503, with the second hydrofoil and the propeller arrangement, is arranged to be turned in relation to the hull so as to steer the boat.

Figure 17:
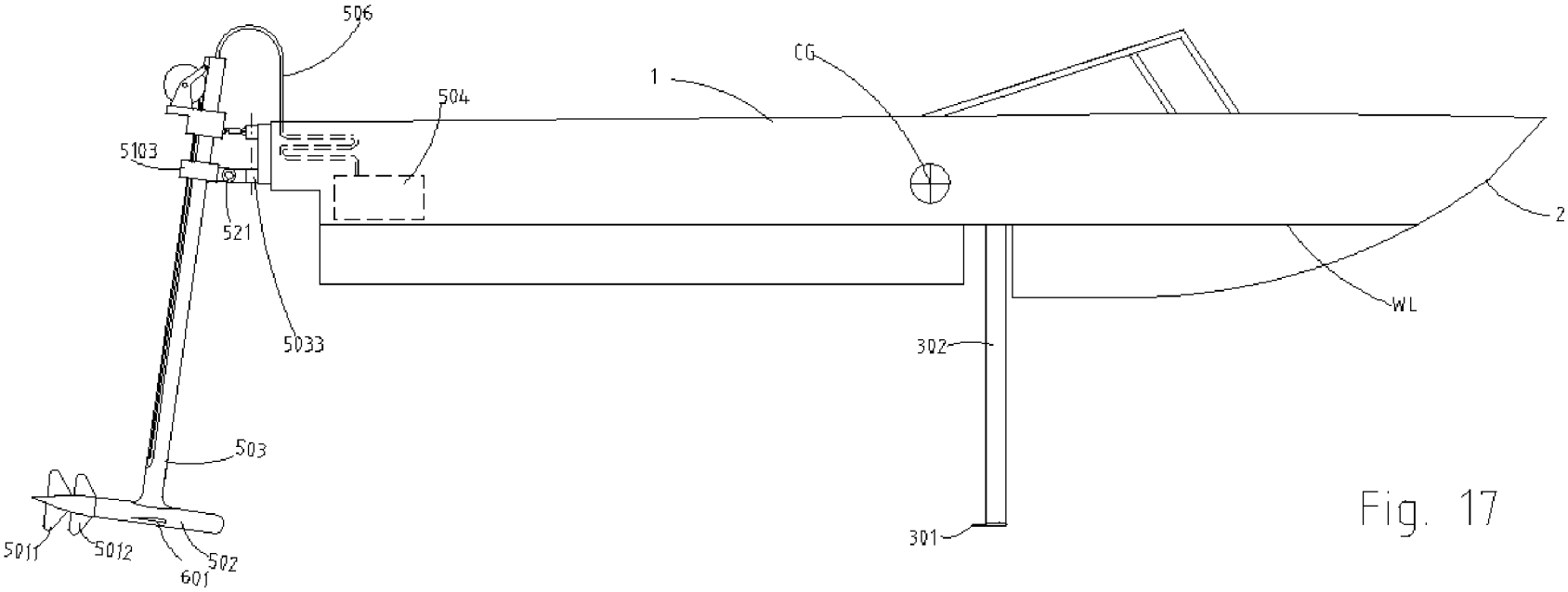
FIG. 17 shows a side view of a boat according to yet another embodiment of the invention.

Reference is made to FIG. 17, showing a further embodiment of the invention. The embodiment is similar to the one shown in FIG. 14-FIG. 16, with the following exception. The second hydrofoil strut 503 is arranged to be tilted around an axis which is substantially horizontal when the boat is floating in an upright condition, and substantially lateral to a direction of straight travel of the boat. Thereby, the second hydrofoil strut may be tilted backwards or forwards. Thereby, the second hydrofoil strut is tilted for adjusting angle of attack of the second hydrofoil 601.

The tilting is provided by a tilt bearing 521. The tilt bearing connects the second hydrofoil strut holding assembly 5103 with the strut turning bearing assembly 5033.

Figure 18:
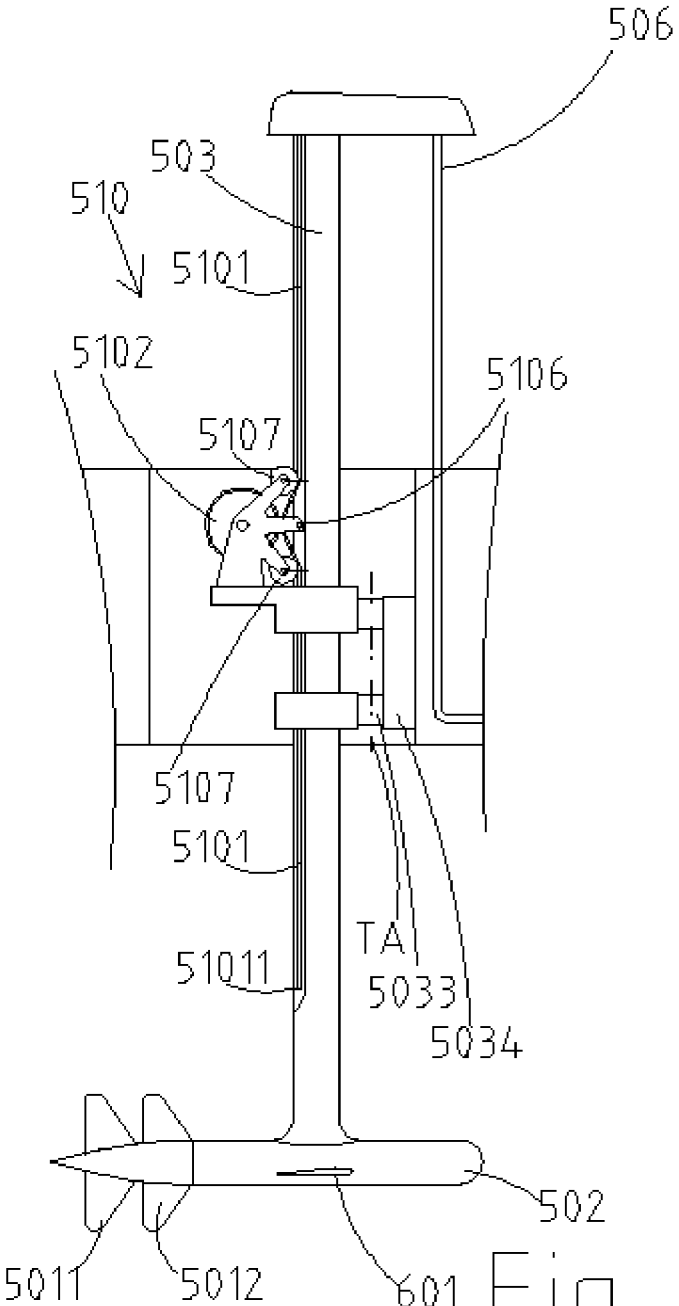
FIG. 18 and FIG. 19 show respective details similar to the one shown in FIG. 3, with respective strut adjustment arrangements in respective alternative embodiments of the invention

Reference is made to FIG. 18 showing a strut adjustment arrangement 510 in an alternative embodiment of the invention.

As in the embodiments described above, the strut adjustment arrangement 510 comprises an elongated flexible device 5101 in the form of a rope, wire, or cable. The elongated flexible device 5101 is would, one or more turns around a drum or an actuation wheel 5102, arranged to be driven by a driving device, such as a motor. The actuation wheel 5102 may have a coarse surface or a toothed circumferential track (not shown) for avoiding slippage of the elongated flexible device 5101 on the actuation wheel 5102. The drum 5102 with the driving device is mounted to a strut holding assembly 5103.

One end of the elongated flexible device 5101 is fastened to the strut 503 below the actuation wheel 5102. The other end of the elongated flexible device 5101 is fastened to the strut 503 above the actuation wheel 5102. The strut extends though the strut holding assembly 5103. The strut holding assembly 5103 comprises two strut holding brackets. Pulley wheels 5107 are provided to guide the elongated flexible device 5101 from the strut to the actuation wheel 5102, and vice versa.

Thereby, by rotation of the actuation wheel 5102 in one direction, the strut may be pulled upwards by the elongated flexible device 5101 from the extended position to the retracted position (shown in FIG. 18). By rotation of the actuation wheel 5102 in the opposite direction, the strut may be pulled downwards by the elongated flexible device 5101 from the retracted position to the extended position. Thereby, in addition to gravity, the strut may be pulled down by the strut adjustment arrangement 510, e.g. to overcome friction in the strut holding assembly 5103.

Similarly to embodiments described above, the strut adjustment arrangement comprises a locking arrangement for locking the strut in the retracted position, in the extended position, and in the dry position. The locking arrangement comprises a first engagement device provided by a ridge raised from the blunt strut trailing edge and extending along the blunt trailing edge. The ridge comprises three through openings distributed along the strut 503. The through openings are arranged to receive a second engagement device in the form of a male engagement element 5106.

Figure 19:
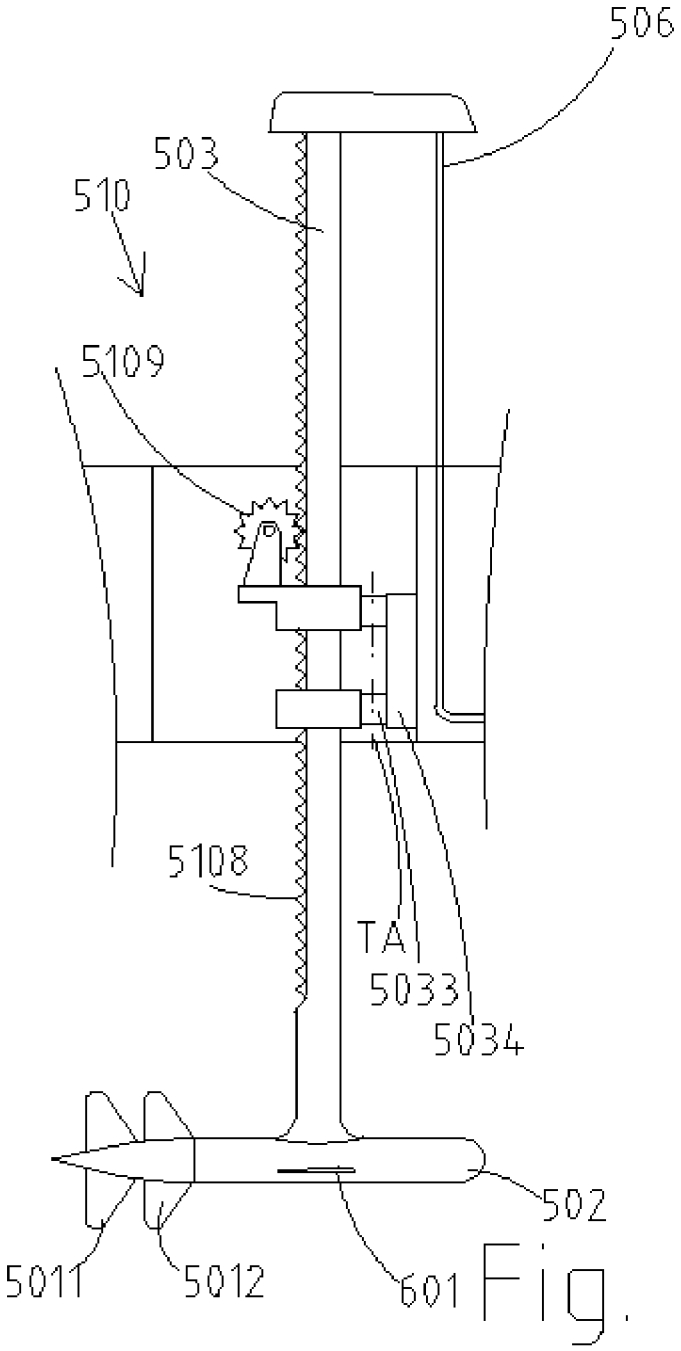

Reference is made to FIG. 19. It is understood that many alternatives are possible for the strut adjustment arrangement. For example, the strut trailing edge may be provided with teeth 5108 distributed along the trailing edge. Thereby, a motorized toothed wheel 5019, fixed to the strut holding assembly, may be arranged to engage with the strut teeth, and rotate, so as to drive the strut up or down. Thereby, a portion of the strut may have a hydrodynamic portion forming a leading edge and a blunt trailing edge. Thereby, the teeth 5108 are preferably positioned so as to be located behind the blunt trailing edge as seen in the direction of straight forward travel of the boat. Thereby, at least some of the teeth 5108 form a sheltered portion of the strut adjustment arrangement. The teeth 5108 may form first engagement devices, and the wheel 5109 may form a second engagement device arranged to engage with the teeth 5108 to lock the strut in the retracted position.

Figure 20:
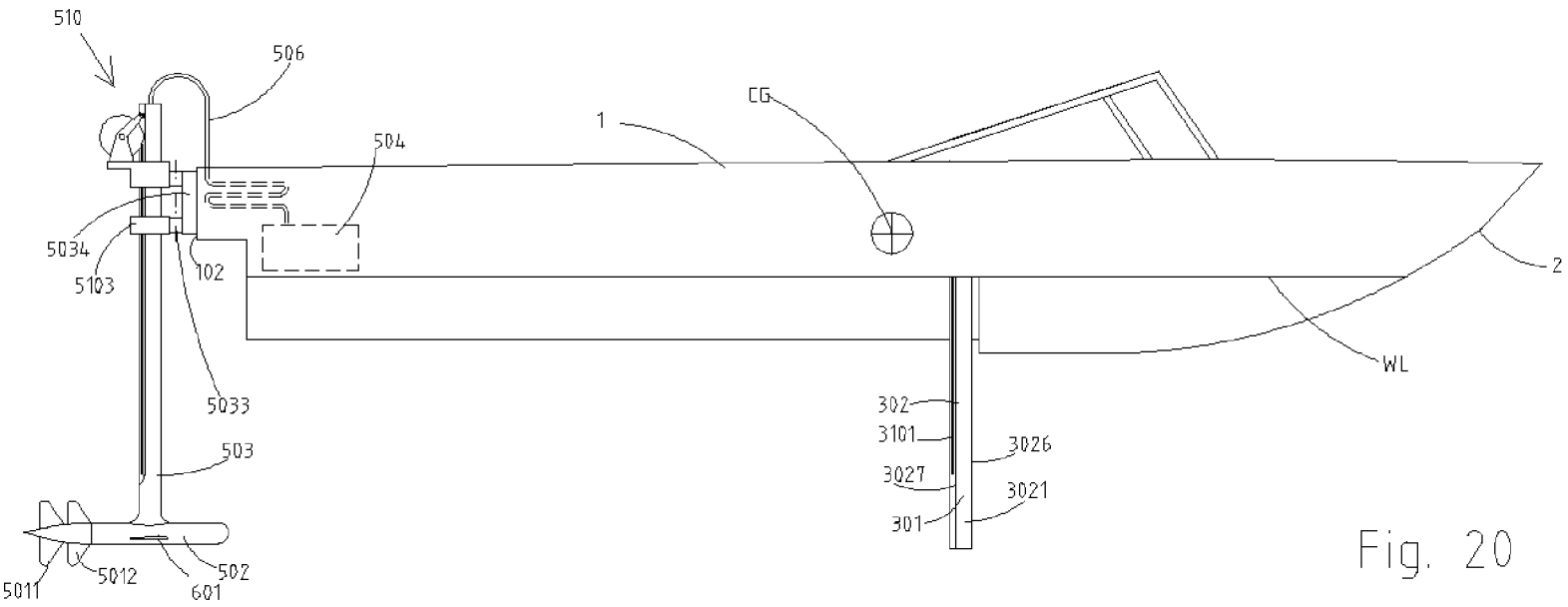
FIG. 20 shows a side view of a boat according to a further embodiment of the invention.
Figure 21:
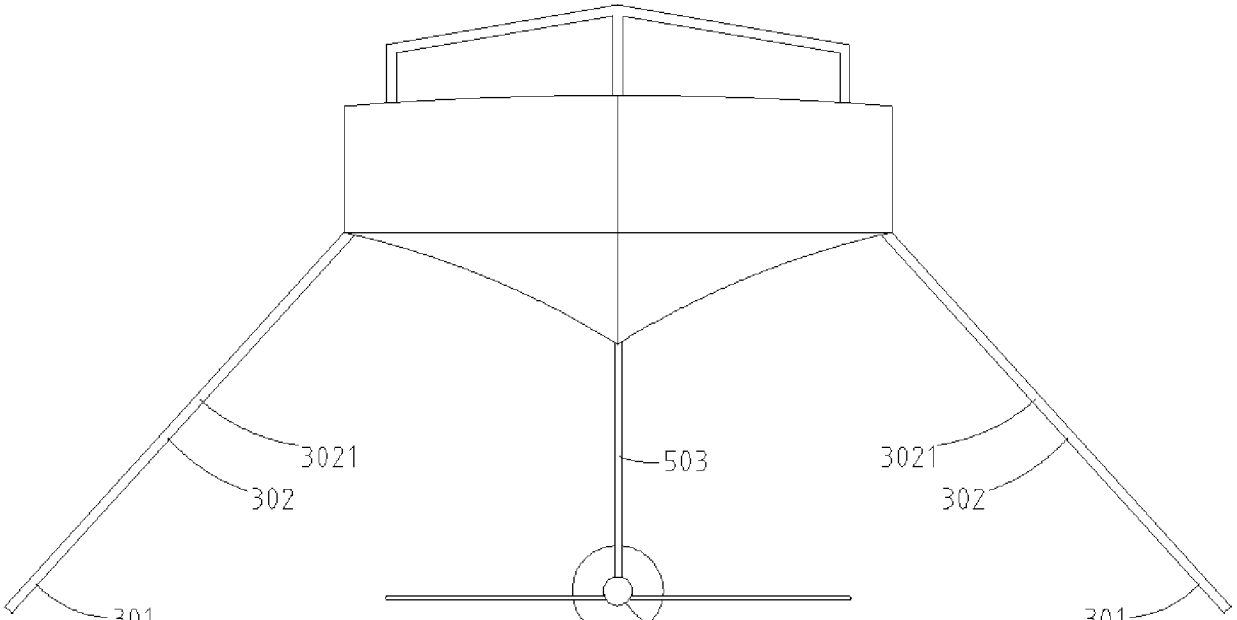
FIG. 21 shows the boat in FIG. 20, as seen from in front of the boat.

Reference is made to FIG. 20 and FIG. 21, showing a further embodiment of the invention. In some embodiments of the invention, the strut 3021, 503 is separate from the hydrofoil 301, 601. The embodiment in FIG. 20 and FIG. 21 is similar to the one shown in FIG. 14-FIG. 16, with the following exception. The boat comprises two first hydrofoils 301. The hydrofoils 301 extend, on opposite sides of a symmetry plane of the hull, partly downwards from the hull, and partly outwards, away from the hull symmetry plane. The hydrofoils 301 are surface piercing.

Each hydrofoil 301 also forms what is herein referred to as a strut 3021. In this embodiment, each hydrofoil 301 and the respective strut 3021 are integrated. Thus, each hydrofoil serves the double propose of providing lift forces to the hull in a hydrofoil mode of the boat, and forming a part of the hydrofoil holding arrangement 302 by means of which the hydrofoil is mounted to the hull.

A strut adjustment arrangement is arranged to retract the strut 3021, i.e. the hydrofoil 301, from an extended position to a retracted position. By the retraction, the hydrofoil 301 is moved from a deployed position, shown in FIG. 16 and FIG. 21, to a restrained position (not shown).

The strut 3021, i.e. the hydrofoil 301, has a hydrodynamic portion forming a leading edge 3026 and a blunt trailing edge 3027. Similarly to embodiments described above, the strut adjustment arrangement comprises an elongated flexible device 3101 arranged to pull the strut from the extended position to the retracted position. Thereby, the strut 3021 is arranged to be retracted by lifting the one or more struts along their longitudinal axes.

A portion of the elongated flexible device 3101 extends along the blunt trailing edge 3027. Thereby, the elongated flexible device 3101 is positioned behind the blunt trailing edge as seen in the direction of straight forward travel of the boat.

Figure 22:
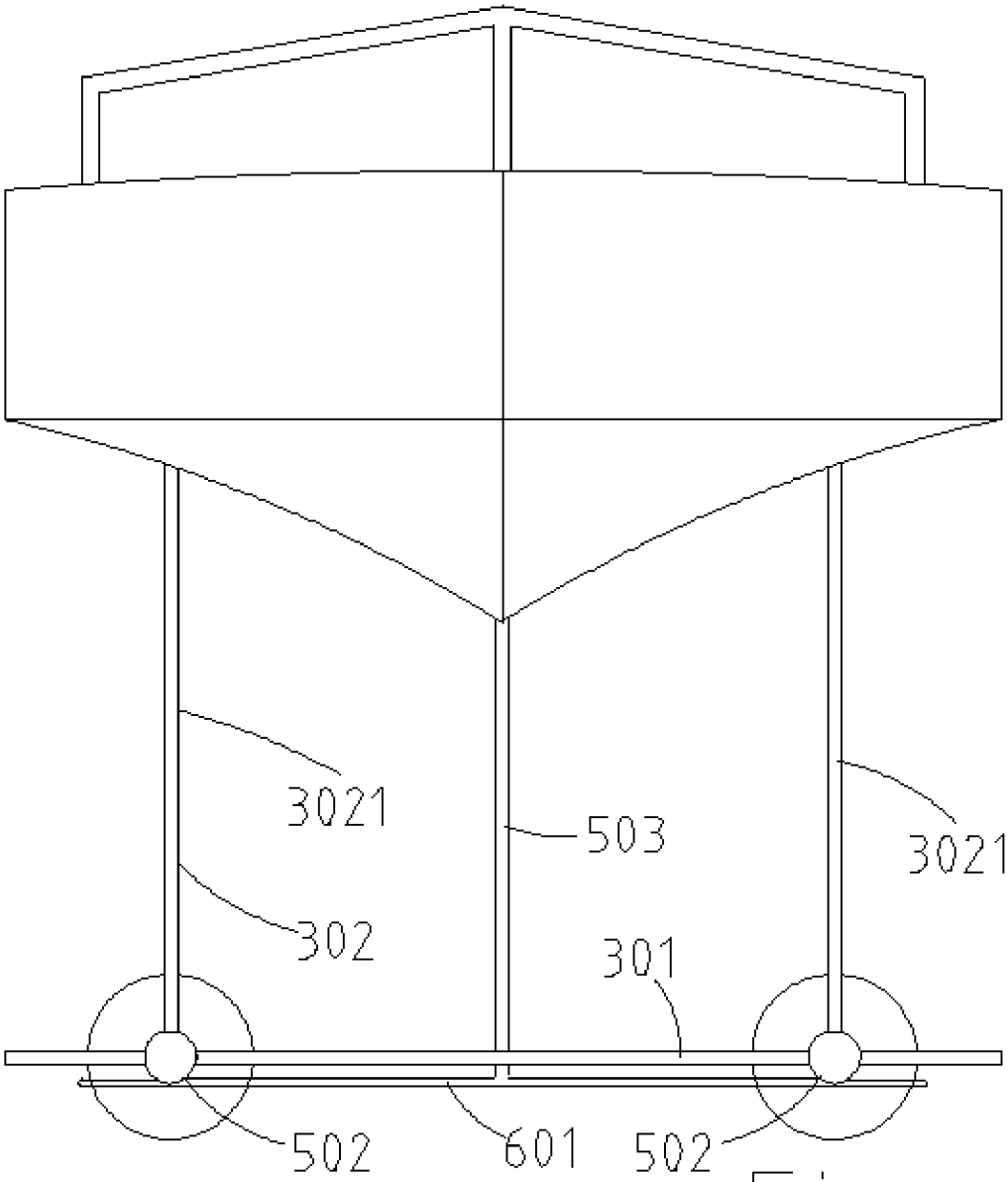
FIG. 22 shows a front view of a boat according to a further embodiment of the invention.

FIG. 22 shows a front view of a boat according to yet another embodiment of the invention. The boat is similar to the boat described with reference to FIG. 10-FIG. 12, with the following differences.

The boat comprises two motor pods 502. Each motor pod 502 is fixed to the first hydrofoil 301 and a respective of the first hydrofoil struts 3021. Thereby, each motor pod 502 is fixed at a junction between the first hydrofoil 301 and the respective first hydrofoil strut 3021. Thereby, an intermediate part of the first hydrofoil 301 and a respective cantilevered end part of the first hydrofoil 301 extend on opposite sides from the respective motor pod.

While not shown in detail in FIG. 22, similarly to the embodiment in FIG. 10-FIG. 12, for each motor pod 502, the first hydrofoil 301 comprises a curved part partly surrounding the motor pod casing in a recess of the casing. The curved part connects the intermediate part of the first hydrofoil 301 and the respective cantilevered end part of the first hydrofoil 301. A lower end of the respective first hydrofoil strut 3021 surrounds the remainder of the respective casing circumference while extending into the recess. The respective first hydrofoil strut 3021 and the hydrofoil 301 are connected on opposite sides of the respective motor pod 502, e.g. by bolts.

It is to be understood that the present invention is not limited to the embodiments described above and illustrated in the drawings; rather, the skilled person will recognize that many changes and modifications may be made within the scope of the appended claims.

One or more of the following paragraphs may be claims in one or more divisional patent applications:

Paragraph 1: A boat comprising a hull (2), a first hydrofoil (301) mounted to the hull (2) by means of a first hydrofoil holding arrangement (302), a second hydrofoil (601) mounted to the hull (2) by means of a second hydrofoil holding arrangement comprising a strut (503) which is separate from the first hydrofoil holding arrangement (302), the strut (503) being arranged to extend at least partly downwards from the hull (2), the second hydrofoil being fixed to the strut, a torque generating assembly (5051, 5052), and a propeller arrangement (5011, 5012) arranged to be driven by the torque generating assembly, wherein the propeller arrangement (5011, 5012) is mounted to the strut (503), wherein the strut (503) is arranged to be retracted from an extended position to a dry position in which the propeller arrangement (5011, 5012) and the second hydrofoil (601) are above the water surface when the boat is floating at rest, wherein the arrangement of the strut (503) to be retracted from the extended position to the dry position comprises the strut being arranged to be moved along a longitudinal axis of the strut.

Paragraph 2: A boat according to paragraph 1, wherein the strut (503) is arranged to be retracted from the extended position to a retracted position so as to move the propeller arrangement (5011, 5012) from a deployed position to a restrained position, in which restrained position the propeller arrangement is positioned to be submerged in water carrying the boat, wherein the propeller arrangement is, in the deployed position, located further down than in the restrained position, wherein, in the extended position as well as in the retracted position, the strut (503), with the propeller arrangement (5011, 5012), is arranged to be turned in relation to the hull so as to steer the boat.

Paragraph 3: A boat according to any one of the preceding paragraphs, wherein the second hydrofoil (601) is fixed to the strut (503) at a position along a longitudinal extension of the strut being within an extension of the propeller arrangement (5011, 5012) along the longitudinal extension of the strut.

Paragraph 4: A boat comprising a hull (2), a first hydrofoil (301) mounted to the hull (2) by means of a first hydrofoil holding arrangement (302), a second hydrofoil (601) mounted to the hull (2) by means of a second hydrofoil holding arrangement comprising a strut (503) which is separate from the first hydrofoil holding arrangement (302), the strut (503) being arranged to extend at least partly downwards from the hull (2), the second hydrofoil being fixed to the strut, a torque generating assembly (5051, 5052), and a propeller arrangement (5011, 5012) arranged to be driven by the torque generating assembly, wherein the propeller arrangement (5011, 5012) is mounted to the strut (503), wherein the strut (503) is arranged to be retracted from an extended position to a retracted position so as to move the propeller arrangement (5011, 5012) from a deployed position to a restrained position, in which restrained position the propeller arrangement is positioned to be submerged in water carrying the boat, wherein the propeller arrangement is, in the deployed position, located further down than in the restrained position, wherein, in the extended position as well as in the retracted position, the strut (503), with the propeller arrangement (5011, 5012), is arranged to be turned in relation to the hull so as to steer the boat, wherein the first hydrofoil holding arrangement (302) for mounting the first hydrofoil (301) to the hull is arranged to be retracted from an extended position to a retracted position so as to move the first hydrofoil from a deployed position to a restrained position, wherein the first hydrofoil is, in the deployed position, located further down than in the restrained position, wherein the first hydrofoil is in the restrained position arranged to be submerged.

Paragraph 5: A boat comprising a hull (2), and a motor pod (502) and a submergible structure (301, 302, 503, 601), wherein the motor pod (502) is mounted to the hull (2) by means of the submergible structure, wherein the motor pod comprises a torque generating assembly, and a propeller arrangement arranged to be driven by the torque generating assembly, wherein the motor pod further comprises a casing (5021), wherein the torque generating assembly is housed in the casing, wherein the casing comprises a recess (2025), and the submergible structure extends into the recess of the casing, wherein the submergible structure comprises a hydrofoil that partly surrounds the casing, and a further element that partly surrounds the casing so that the further element and the hydrofoil together fully surround the casing, wherein the further element and the hydrofoil are fastened to each other.

Paragraph 6: A boat according to paragraph 5, wherein, along at least a portion of a circumference of the casing (5021), the extension, in the longitudinal direction of the casing, of the submergible structure (503, 601), is the same as the extension (RE) of the recess in the longitudinal direction of the casing.

Paragraph 7: A boat according to any one of paragraphs 5-6, wherein the submergible structure (503, 601) comprises a hydrofoil holding arrangement (302, 503), wherein the hydrofoil (301, 601) is mounted to the hull (2) by means of the hydrofoil holding arrangement.

Paragraph 8: A boat according to paragraph 7, wherein the hydrofoil holding arrangement (302, 503) comprises a strut (3021, 503), wherein the hydrofoil and the motor pod are at substantially the same position along the strut.

Paragraph 9: A boat according to any one of paragraphs 5-8, wherein the further element is a strut.

Paragraph 10: A boat according to any one of paragraphs 5-9, wherein the hydrofoil as well as the further element extend into the recess of the casing.

Paragraph 11: A combination of a motor pod (502) and a submergible structure, for a boat comprising a hull (2), wherein the motor pod (502) is arranged to be mounted to the hull (2) by means of the submergible structure, wherein the motor pod comprises a torque generating assembly, and a propeller arrangement arranged to be driven by the torque generating assembly, wherein the motor pod further comprises a casing, wherein the torque generating assembly is housed in the casing, wherein the casing comprises a recess, and the submergible structure extends into the recess of the casing, wherein the submergible structure comprises a hydrofoil that partly surrounds the casing, and a further element that partly surrounds the casing so that the further element and the hydrofoil together fully surround the casing, wherein the further element and the hydrofoil are fastened to each other.

The invention claimed is:

1. A boat comprising a hull, a hydrofoil mounted to the hull by means of a hydrofoil holding arrangement comprising a strut, wherein the boat comprises a strut adjustment arrangement configured to retract the strut from an extended position to a retracted position so as to move the hydrofoil from a deployed position to a restrained position, and/or to lock the strut in the extended position and/or in the retracted position, wherein at least a portion of the strut has a hydrodynamic portion forming a leading edge and a blunt trailing edge, wherein a sheltered portion of the strut adjustment arrangement is positioned, and/or arranged to be positioned, so that an extension of the sheltered portion in a longitudinal direction of the strut is within an extension of the blunt trailing edge in the longitudinal direction of the strut, and so that the sheltered portion is located behind the blunt trailing edge as seen in the direction of straight forward travel of the boat, and/or in one or more cavities in the hydrodynamic portion, which one or more cavities extend from the blunt trailing edge, wherein the sheltered portion of the strut adjustment arrangement is, or is arranged to be, entirely within a maximum distance (MD) from the blunt trailing edge, which maximum distance is at least 20%, of the extension of the hydrodynamic portion along the chord line of the hydrodynamic portion.

2. A boat according to claim 1, wherein the sheltered portion of the strut adjustment arrangement extends, or is arranged to extend, transversely to a chord line (CL) of the hydrodynamic portion no further from the chord line than the extension (TE) of the blunt trailing edge in a direction which is transverse to the chord line.

3. A boat comprising a hull, a hydrofoil mounted to the hull by means of a hydrofoil holding arrangement comprising a strut, wherein the boat comprises a strut adjustment arrangement configured to retract the strut from an extended position to a retracted position so as to move the hydrofoil from a deployed position to a restrained position, and/or to lock the strut in the extended position and/or in the retracted position, wherein at least a portion of the strut has a hydrodynamic portion forming a leading edge and a blunt trailing edge, wherein a sheltered portion of the strut adjustment arrangement is positioned, and/or arranged to be positioned, so that an extension of the sheltered portion in a longitudinal direction of the strut is within an extension of the blunt trailing edge in the longitudinal direction of the strut, and so that the sheltered portion is located behind the blunt trailing edge as seen in the direction of straight forward travel of the boat, and/or in one or more cavities in the hydrodynamic portion, which one or more cavities extend from the blunt trailing edge, wherein all parts of the strut adjustment arrangement that are arranged to be under the water surface when the boat is travelling in a hydrofoil mode, are located behind the blunt trailing edge as seen in the direction of straight forward travel of the boat, and/or in one or more cavities in the hydrodynamic portion which one or more cavities extend from the blunt trailing edge.

4. A boat according to claim 1, wherein the boat comprises a propeller arrangement which is mounted to the strut, wherein, when the boat is floating at rest, the blunt trailing edge is terminated above a vertical extension of a propeller disc formed by the propeller arrangement.

5. A boat according to claim 1, wherein the sheltered portion of the strut adjustment arrangement comprises a first engagement device, wherein the strut adjustment arrangement comprises a second engagement device arranged to engage with the first engagement device to lock the strut in the retracted position.

6. A boat comprising a hull, a hydrofoil mounted to the hull by means of a hydrofoil holding arrangement comprising a strut, wherein the boat comprises a strut adjustment arrangement configured to retract the strut from an extended position to a retracted position so as to move the hydrofoil from a deployed position to a restrained position, and/or to lock the strut in the extended position and/or in the retracted position, wherein at least a portion of the strut has a hydrodynamic portion forming a leading edge and a blunt trailing edge, wherein a sheltered portion of the strut adjustment arrangement is positioned, and/or arranged to be positioned, so that an extension of the sheltered portion in a longitudinal direction of the strut is within an extension of the blunt trailing edge in the longitudinal direction of the strut, and so that the sheltered portion is located behind the blunt trailing edge as seen in the direction of straight forward travel of the boat, and/or in one or more cavities in the hydrodynamic portion, which one or more cavities extend from the blunt trailing edge, wherein the sheltered portion of the strut adjustment arrangement comprises at least a part of an elongated flexible device extending along the blunt trailing edge, wherein the strut is configured to be retracted from the extended position to the retracted position by being pulled by the elongated flexible device.

7. A strut for mounting a hydrofoil to a hull of a boat, wherein the strut comprises one or more parts for a strut adjustment arrangement arranged to retract the strut from an extended position to a retracted position so as to move the hydrofoil from a deployed position to a restrained position, and/or to lock the strut in the extended position and/or in the retracted position, wherein at least a portion of the strut has a hydrodynamic portion forming a leading edge and a blunt trailing edge, wherein the one or more parts for the strut adjustment arrangement are located, in a direction of a chord line of the hydrodynamic portion, on a side of the hydrodynamic portion comprising the blunt trailing edge, and/or in one or more cavities in the hydrodynamic portion, which one or more cavities extend from the blunt trailing edge, wherein the one or more parts for the strut adjustment arrangement are entirely within a maximum distance (MD) from the blunt trailing edge, which maximum distance is at least 20%, of the extension of the hydrodynamic portion along the chord line of the hydrodynamic portion.

8. A strut according to claim 7, wherein the one or more parts for the strut adjustment arrangement are located within an extension (TE) of a surface formed by the blunt trailing edge, which extension is transverse to a chord line (CL) of the hydrodynamic portion.

9. A strut according to claim 7, wherein the blunt trailing edge formed by the hydrodynamic portion is formed by one or more surfaces that form, in a transverse cross-section of the strut, one or more angles of 70-110 degrees, to a chord line of the hydrodynamic portion.

* * * * *